US008882399B2

(12) United States Patent
Ortega

(10) Patent No.: US 8,882,399 B2
(45) Date of Patent: Nov. 11, 2014

(54) STRONG NONWOVEN FABRICS FOR USE IN SILT CONTROL SYSTEMS

(71) Applicant: Cerex Advanced Fabrics, Inc., Cantonment, FL (US)

(72) Inventor: Albert E. Ortega, Pensacola, FL (US)

(73) Assignee: Cerex Advanced Fabrics, Inc., Cantonment, FL (US)

( * ) Notice: Subject to any disclaimer, the term of this patent is extended or adjusted under 35 U.S.C. 154(b) by 0 days.

(21) Appl. No.: 13/829,312

(22) Filed: Mar. 14, 2013

(65) Prior Publication Data

US 2014/0072375 A1 Mar. 13, 2014

Related U.S. Application Data

(60) Provisional application No. 61/698,291, filed on Sep. 7, 2012, provisional application No. 61/758,547, filed on Jan. 30, 2013.

(51) Int. Cl.
*E02D 17/02* (2006.01)
*E02D 17/20* (2006.01)

(52) U.S. Cl.
CPC ..... *E02D 17/202* (2013.01)
USPC ..... 405/302.7

(58) Field of Classification Search
USPC ..... 405/302.4, 302.6, 302.7
See application file for complete search history.

(56) References Cited

U.S. PATENT DOCUMENTS

| | | | |
|---|---|---|---|
| 5,108,224 | A | 4/1992 | Cabaniss et al. |
| 7,465,129 | B2 | 12/2008 | Singleton |
| RE42,695 | E | 9/2011 | Singleton |
| 2004/0076482 | A1 | 4/2004 | Singleton |

FOREIGN PATENT DOCUMENTS

| | | | |
|---|---|---|---|
| EP | 1367152 | A1 | 12/2003 |
| WO | WO 2010-059246 | A2 | 5/2010 |

OTHER PUBLICATIONS

Jena et al., Advances in Pore Structure Evaluation by Porometry, Chemical Engineering & Technology Journal, vol. 33, Issue 8, pp. 1241-1250 Aug. 2010.

Wolfe et al., Qualitative Valuation of Performance Testing for Sediment Retention Devices, International Erosion Control Association.

*Primary Examiner* — Tara M. Pinnock

(74) *Attorney, Agent, or Firm* — Saliwanchik, Lloyd & Eisenschenk

(57) ABSTRACT

Strong nonwoven fabrics can be used as a sheet in a silt screen fence or other temporary silt screen barrier. The fabrics can be without reinforcements. Enhanced features of these strong nonwoven fabrics can enable them to be used as a sheet in a silt screen fence or other temporary silt screen barrier without adding additional processing steps. A strong nonwoven fabric without internal or external reinforcement that does not tear easily and has excellent light stability can be used.

20 Claims, 9 Drawing Sheets

STRONG NONWOVEN FABRICS FOR USE IN SILT CONTROL SYSTEMS

CROSS-REFERENCE TO A RELATED APPLICATION

This application claims the benefit of U.S. provisional application Ser. No. 61/698,291, filed Sep. 7, 2012 and U.S. provisional application Ser. No. 61/758,547, filed Jan. 30, 2013, both of which are incorporated herein by reference in their entireties.

FIELD OF THE INVENTION

This invention relates to strong nonwoven fabrics that can be used in silt control systems, e.g., as a sheet for a silt fence or other temporary silt screen barriers. This invention also relates to fabrics with enhanced properties and features that can be used to control erosion of silt in construction and excavation projects. Features such as color and UV stability are built into the fabric with little to no additional processing so that additional costs of producing a fabric with added features are minimized. The added feature of color can allow the fabric to also be used as a highly visible warning barrier.

BACKGROUND OF THE INVENTION

Soil often erodes from a construction site when rain falls on bare ground left exposed during construction work. Various methods, from staked hay bales to engineered silt fences, are used to control soil erosion. A silt fence is a temporary barrier designed to inhibit sediment from migrating away from construction sites via storm water runoff to protect water quality in nearby streams, rivers, lakes, and seas. The fence retains sediment primarily by retarding flow and promoting deposition on the uphill side of the fence. Runoff is also filtered as it passes through the material of the fence. Silt fences are widely used on construction sites in North America and elsewhere because of their low cost and simple design although their effectiveness in controlling sediment is often rather limited because of problems with design, installation, maintenance, or any combination of these.

BRIEF SUMMARY OF THE INVENTION

Embodiments of the subject invention are drawn to advantageous silt fences and sheets using strong nonwoven fabrics, methods of manufacturing said silt fences and sheets, and methods of using said silt fences and sheets. Strong nonwoven fabrics can be used as a sheet material in a silt screen fence or other temporary silt screen barrier. In many embodiments, strong nonwoven fabrics without any reinforcement can be used. Such fabrics are still strong enough to function in a silt screen or other barrier but advantageously do not require additional processing steps and/or costs associated with providing reinforcement.

DETAILED DISCLOSURE OF THE INVENTION

Figure 1:
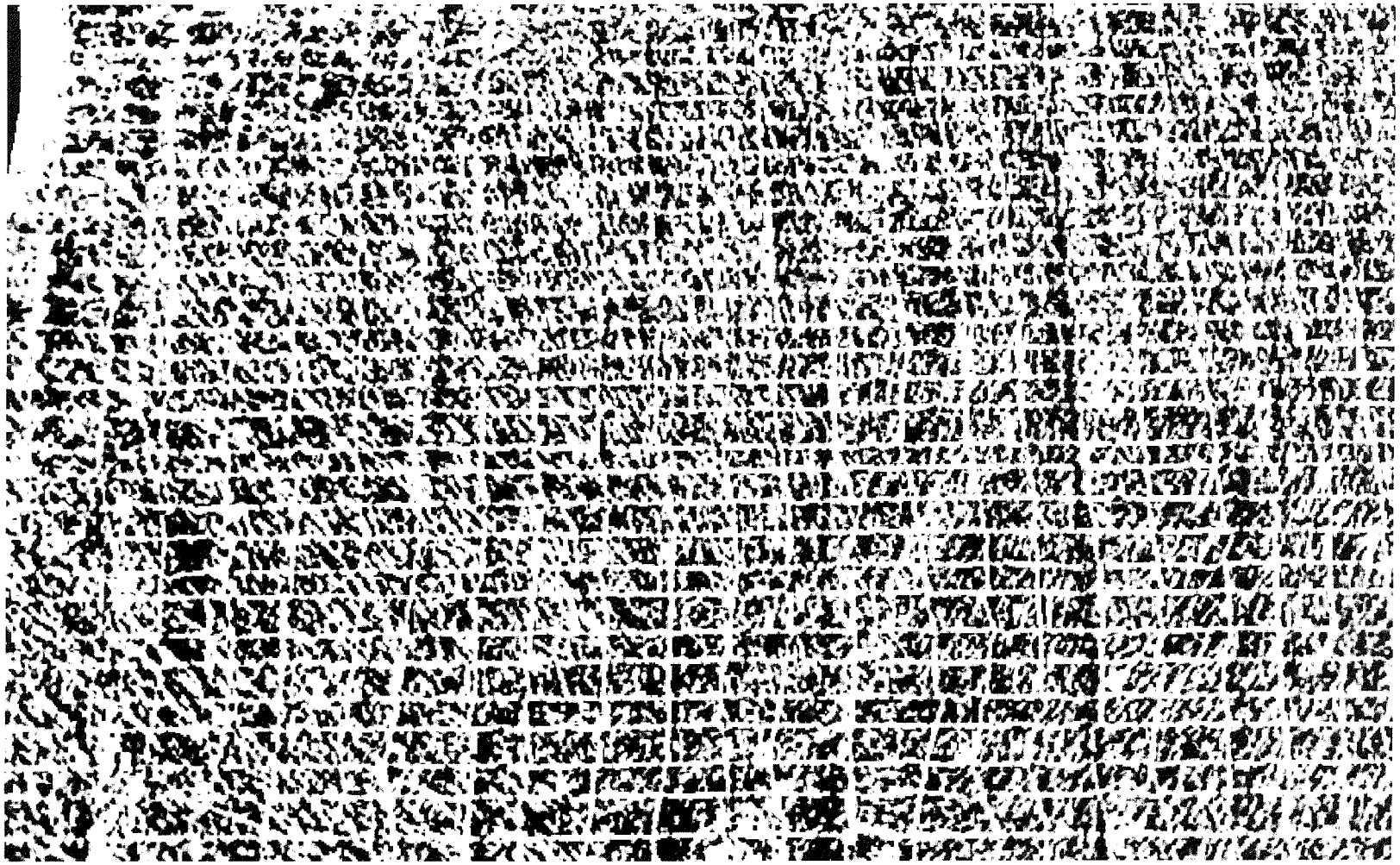
FIG. 1 shows an existing fabric.

In the following detailed description of the subject invention and its preferred embodiments, specific terms are used in describing the invention; however, these are used in a descriptive sense only and not for the purpose of limitation. It will be apparent to the skilled artisan having the benefit of instant disclosure that the invention is susceptible to numerous variations and modifications within its spirit and scope.

When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

Embodiments of the subject invention are drawn to advantageous silt fences and sheets using strong nonwoven fabrics, methods of manufacturing said silt fences and sheets, and methods of using said silt fences and sheets. Strong nonwoven fabrics can be used as a sheet material in a silt screen fence or other temporary silt screen barrier. In many embodiments, strong nonwoven fabrics without any reinforcement (e.g., a scrim or a grid used to hold the fabric together) can be used. Such fabrics are still strong enough to function in a silt screen or other barrier but advantageously do not require additional processing steps and/or costs associated with providing reinforcement.

Nonwoven fabrics of the subject invention have enhanced features which impart the capability of the fabrics to be used as a sheet in a silt screen fence or other temporary silt screen barrier without adding additional processing steps.

Silt fences are sometimes constructed with geotextiles. Runoff can be filtered as it passes through the geotextile. Many silt fences are constructed of woven geotextile fabrics, sometimes reinforced by wire and supported by metal posts. Geotextiles are permeable fabrics that have the ability to separate, protect, or drain water from soil or sediment. Often made from polypropylene or polyester because of their low cost, geotextile fabrics come in three basic forms: woven, needle punched, and heat-bonded. Nylon fabrics can be used when higher strength is required. When fabricating a silt fence, a geotextile fabric can be attached to wooden or metal stakes driven into the ground. The geotextile fabrics are prone to failure, as they usually do not exhibit enough tensile strength to avoid pulling and tearing at the insertion or puncture points of the fasteners as water or debris bear against the fabric when runoff flow passes through it. Tearing can also occur at the time of installation where the fabric is attached to the stake because of the vibration caused when the top of the stake is impacted by a hammering device to force it into the ground. Once the fabric tears, its effectiveness at controlling erosion is compromised. A strong nonwoven that does not easily tear is an improvement to fabrics that are used in existing silt fences.

U.S. Pat. No. 5,108,224 to Cabaniss et al. describes woven fabrics used to make silt control fences. These fabrics are made with warp yarns that are made from flat polypropylene film and with fill yarns made with polypropylene monofilament round yarns. The fabrics are woven in a plain weave. Typical grab tensile strengths of the fabrics as measured by ASTM (formerly known as American Society for Testing and Materials; www.astm.org) D4632 are about 158 to 188 pounds force ($lb_f$) in the warp and about 98 to 134 in the weft. Typical burst strengths of these fabrics are about 320 to 388 $lb_f$. Fences made with woven fabrics tend to tear easily and require a great deal of maintenance. These fabrics also typically lose strength when exposed to sunlight for extended periods of time.

Figure 2:
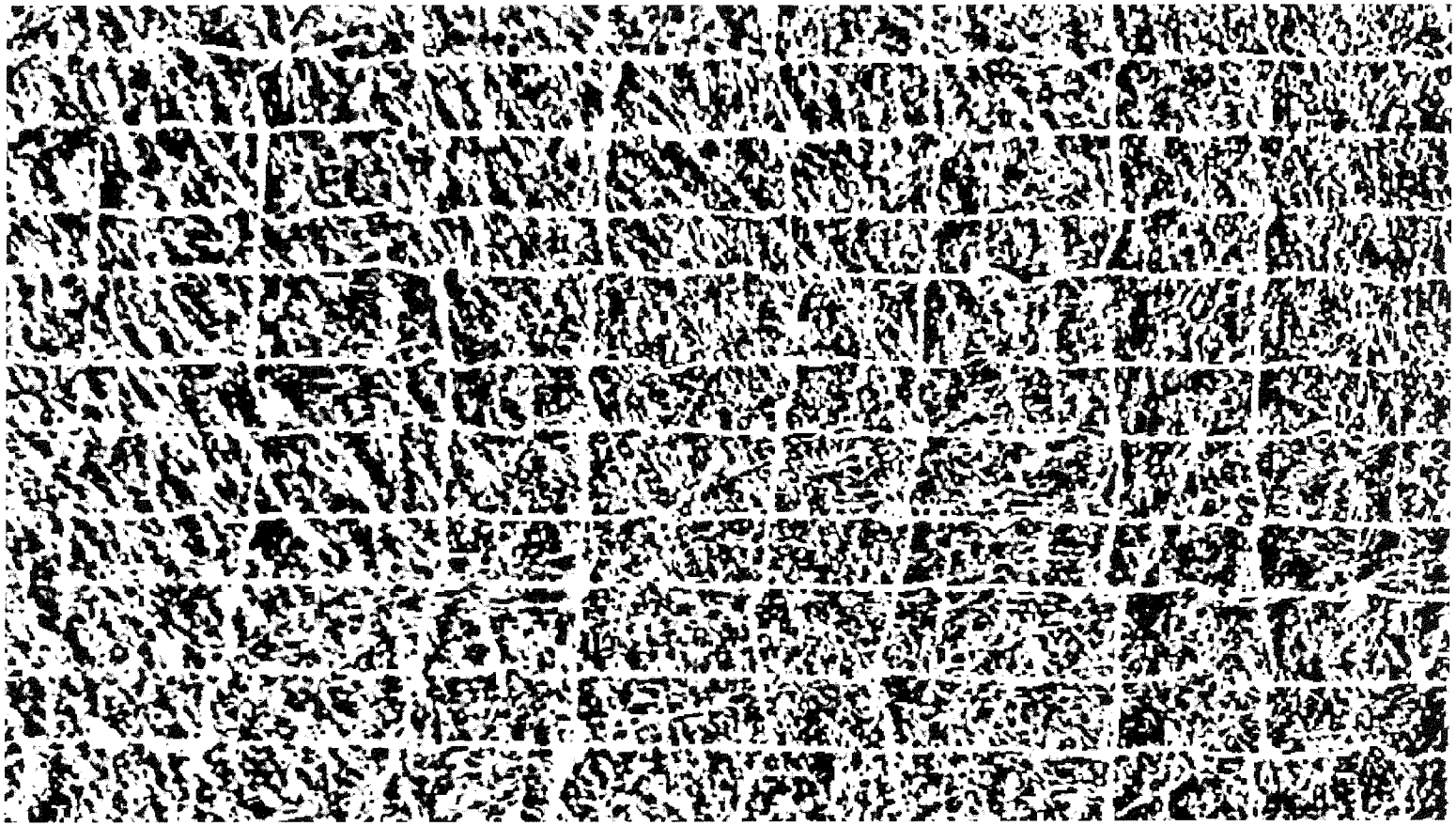
FIG. 2 shows an existing fabric.

Reissued U.S. Pat. No. RE 42,695 E to Singleton describes a reinforced silt retention sheet. This patent describes adding various reinforcing nonwoven materials to make them stronger so as to be able to prevent ripping or tearing. At least one additional processing step is required to practice the art described in Singleton. Adding reinforcement to fabrics requires a second processing step and requires the processing of the reinforcing material. Costs are incurred any time another processing step or another material is added in a manufacturing system. This sheet is made into a silt fence and sold under the trademark "BSRF." A sample of BSRF fabric is shown in FIGS. 1 and 2. The reinforcement grid can be seen in these figures.

The BSRF fabric typically has a basis weight of about 4 to 5 ounces per square yard, with air permeability of about 335 $ft^3/min/ft^2$ as measured using ASTM D737 and a thickness of about 35.4 mils as measured using ASTM D1777. The density of this fabric can be calculated from the basis weight and thickness and is about 0.15 grams per cubic centimeter. The general expectation is that a fabric with lower density and higher air permeability would exhibit better water flow through it. The mean pore size of this fabric is about 47 microns. The flux rate of this fabric was measured by Civil and Environmental Consultants using ASTM D5141 as 0.04 gallons per minute per square foot and an average filter efficiency of 97.3%. Flux rate and filter efficiency of fabrics used to make silt screens are measured using ASTM D5141. The ASTM D5141 testing can be performed by conducting small scale flume runs in a 2.8 foot wide by 4 foot long flume sloped at about 8%. A fifty liter aqueous mixture of soil can be prepared at a concentration of 3,000 milligrams per liter of suspended solids and passed into the flume at a rate of no less than five liters per second. Both solid retention and flow rates through the fabric can then be derived from this test. It would be expected that a fabric with lower permeability either measured using an air permeability test or a liquid permeability test and lower thickness would not perform as well. It would also be expected that a fabric that has higher density would not allow water to flow through it as well and would have a lower flux rate. It would be advantageous to have a fabric that is thinner and has a higher efficiency and a higher flux rate. More yards of this fabric can also be transported to remote areas where construction is occurring thereby providing a more effective silt screen fabric and saving on transportation costs. Reissued U.S. Pat. No. RE 42,695 E also does not discuss the performance of the silt retention sheet after the material has been exposed to sunlight for a period of time.

According to many embodiments of the subject invention, a thermally bonded fabric can be bonded over about 17% to 25% of the fabric area. These bond points are not porous and are actually tiny areas of film in the fabric making the fabric less open. When water and silt encounter the front surface of these fabrics with the lower mean pore size and less open area than other fabrics like the BSRF fabric, the silt is efficiently separated from the water and begins to plug the pores of the fabric. The water can experience a loss of kinetic energy because of a reduction in velocity as the water column encounters the fabric. The silt can settle as the water velocity decreases. The elevation of the water can steadily increase, forcing the water into the fabric and exerting force on the fabric. This force can stretch the fabric, depending on the fabric's ability to stretch as measured by the elongation. Fabrics according to the subject invention have good elongation properties. As the fabric stretches, the void space becomes larger, allowing the water to more readily flow through the fabric. The height of the water can continue to increase until the flow of the water at the face of the fabric is equal or approximately equal to the flow of the water leaving the fabric. As the water rises, it will contact more clean fabric surface allowing higher flow rates (flux rates) through the fabric while maintaining high silt separation efficiency.

Silt sheets and fences according to the subject invention address the need for a strong fabric with one or more enhanced features that can be used in a silt fence that does not require reinforcement and that does not tear easily during installation or when holding back flow of water, debris, or silt. Embodiments of the subject invention provide improvements over existing silt fences and sheets by providing strong nonwoven fabrics that can retain their strength when exposed to sunlight, that have high visibility, that require only one processing step to produce, that do not tear easily, and that can be used as silt retention sheets.

Nonwoven fabrics have several advantages, including lower cost and ability to be manufactured with fewer production steps relative to woven fabrics. Also, the time required to convert raw materials such as polymer pellets to fabrics is much less when weaving is omitted.

Figure 3:
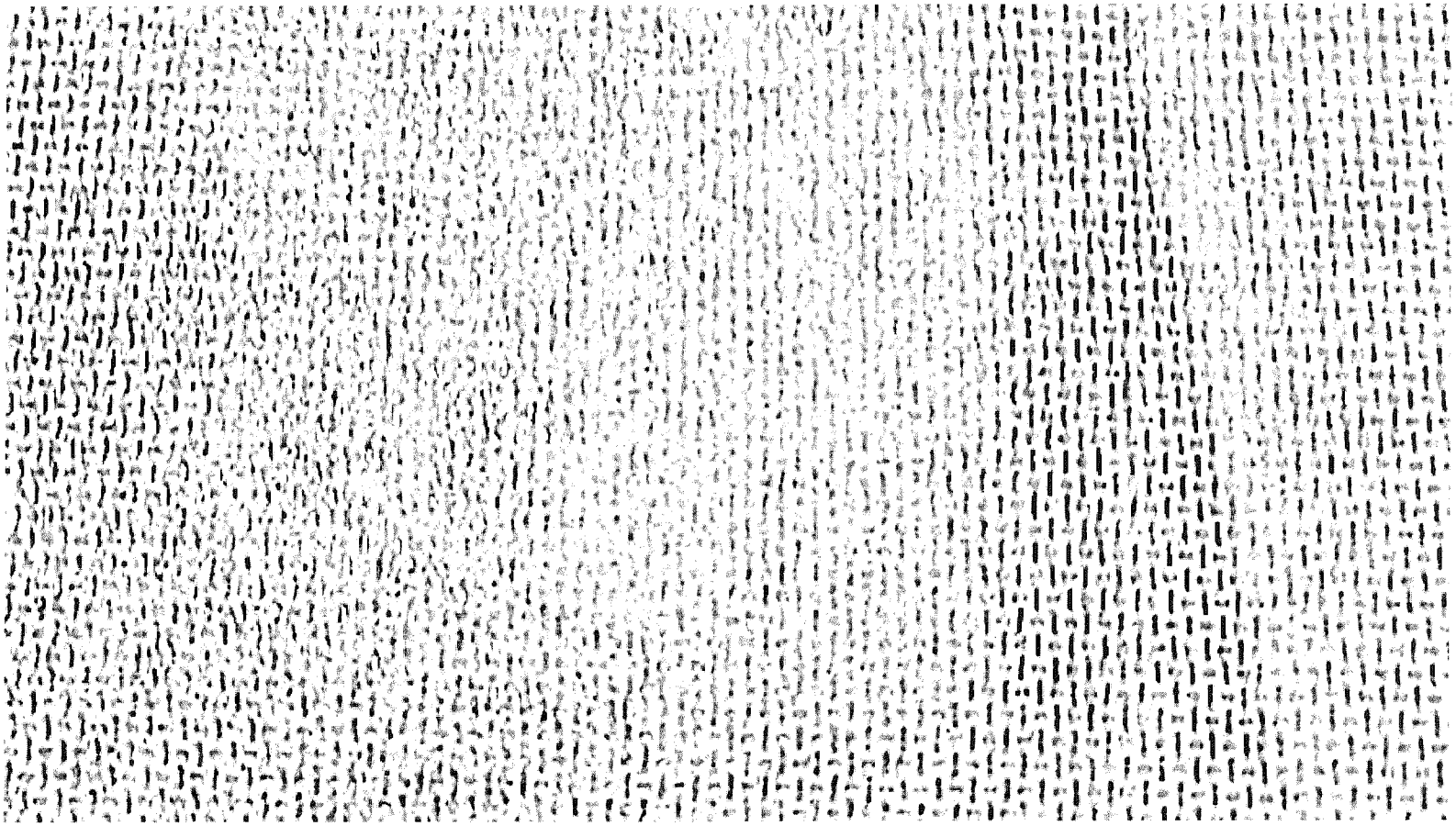
FIG. 3 shows a fabric according to an embodiment of the subject invention.
Figure 4:
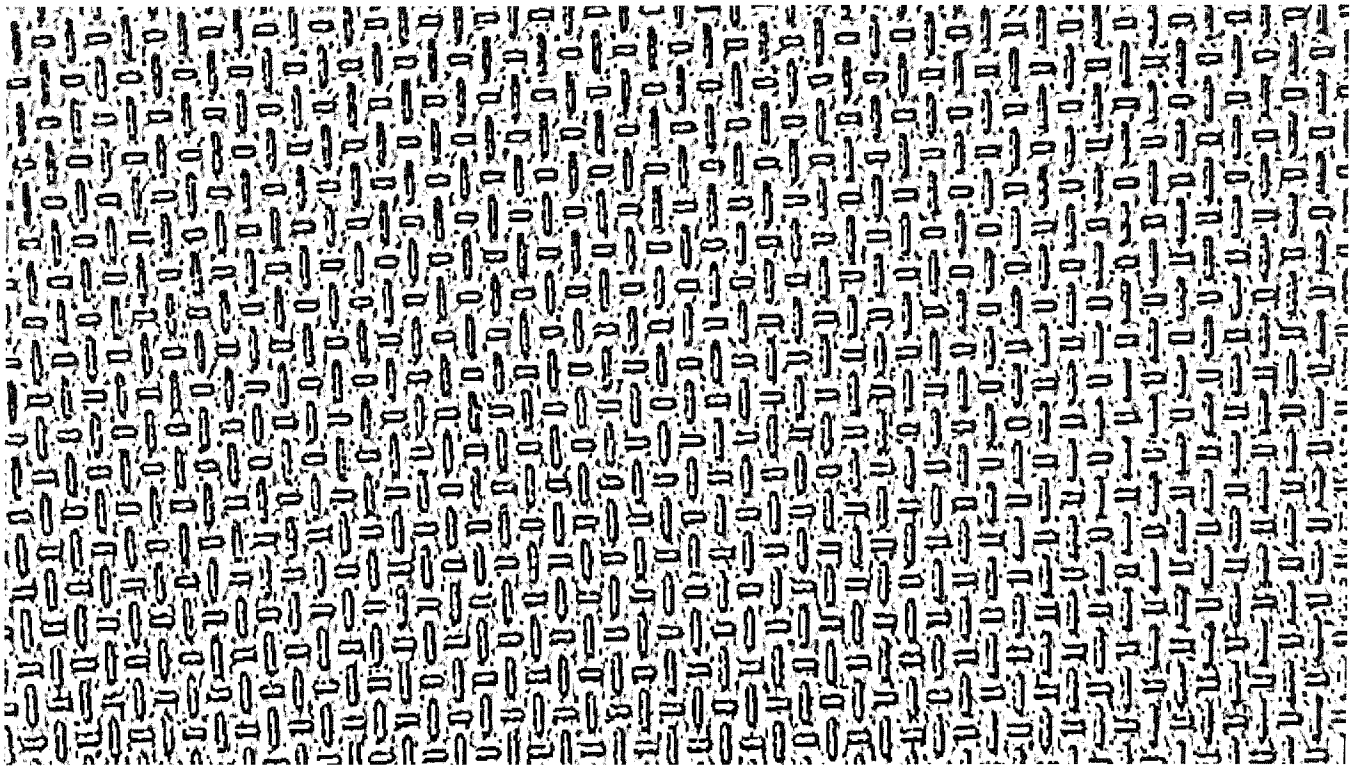
FIG. 4 shows a fabric according to an embodiment of the subject invention.

In an embodiment, a fabric used for a silt screen, fence, or other barrier can be a continuous filament nonwoven and can be, for example, autogenously bonded or thermally bonded with a pattern. Such fabrics tend not to tear easily. FIGS. 3 and 4 show examples of a fabric according to an embodiment of the subject invention. No related art silt screens or silt fences exist which use a thermally-bonded fabric with a pattern (i.e., no existing fabrics used which are thermally-bonded and are not relatively smooth).

In many embodiments, a nonwoven fabric with high tensile strength can be used as the sheet material in a silt fence. Such fabrics can be configured to meet the permeability and/or separation performance required by the specific application.

In an embodiment, an erosion control sheet can be made using a single strong nonwoven fabric that does not tear when loaded with, e.g., water, silt, and/or debris, or when attaching the fabric to stakes or other apparatus(es) used to support a silt retention fence system. In many embodiments, a nonwoven fabric used in a silt retention fence system (e.g., screen, fence, barrier) does not have any reinforcement (i.e., the fabric has no scrim, grid, or other reinforcing structure).

In certain embodiments, nonwoven fabrics used in silt retention fence systems can have product enhancements. Enhancements include one or more of the following: color, colorfastness, antimicrobial capability, antifungal capability, ultraviolet (UV) degradation resistance, light degradation resistance, strength retention when weathered, water repellency, oil adsorption, oil absorption, water permeability, and retention capability of solids such as silt, clay and soil; though embodiments are not limited thereto.

In order to include product enhancements, difficulties encountered in typical fabric-enhancements must be overcome. These difficulties include but are not limited to: the costs of the additive or additives; the ability of the additive or additives to withstand processing temperatures (e.g., 315° C. or higher); the availability of certain pigments and dyes that do not contain hazardous materials (e.g., lead and hexavalent chromium) and that maintain color when weathered, (e.g., exposure to outside conditions such as UV radiation, sunlight, water, and rain) and that are compatible with the materials used to make the fabric (e.g., the polymer(s) and other additives); the potential of certain additives that provide a specific enhancement to plate out metal and plug filters and packs; the availability of additives that are compatible with the polymer processing system and the dyes or pigments that are used to make fabric; the availability of colorfast dyes and pigments that do not wash out; the additive levels can be so high that the quality of the spinning process can deteriorate and increase costs because of processing inefficiencies; and additive levels required to meet the product requirements can be so high that the cost of adding such a high level of additives can inhibit the fabric from being introduced into the market at a competitive price. Often, in existing fabrics, master batch add-in levels above 3% can start causing processing problems. Sometimes, in existing fabrics, master batch add-in levels above 1% can start causing processing problems.

Dyes or other materials that impart high visibility colors (e.g., orange and red) commonly include hazardous materials, for example, metals such as hexavalent chromium and/or lead. Only a few materials exist that can impart high visibility colors, do not contain these hazardous materials, and can tolerate the high temperatures required in processing polymer pellets into fabrics. In certain embodiments, a nonwoven fabric used in a silt retention system as described herein can include one or more dyes or other materials, thereby resulting in a nonwoven fabric with a high visibility color (e.g., orange or red). Such a dye or other material does not contain hazardous materials, such as hexavalent chromium or lead. This fabric will pass the criteria for NSF/ANSI Standard 61 (can be found at www.nsf.org), which is the nationally (in the United States) recognized health standard for all devices, components, and materials that contact drinking water. This fabric will also pass the criteria for SW-846, which is the EPA standard for allowing wastes to be treated as non-hazardous waste.

As used herein, NSF/ANSI Standard 61 refers to the most recent edition of NSF/ANSI Standard 61, which is NSF/ANSI Standard 61-2007a. Also, as used herein, SW-846 refers to the most recent edition of SW-846, which is SW-846. Third Edition.

A nonwoven fabric used in a silt retention fence system can have a basis weight of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in ounces per square yard (osy)): 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1, 1.05, 1.1, 1.15, 1.2, 1.25, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5, 5.5, 6, 6.5, 7, 7.5, 8, 8.5, 9, 9.5, 10, 11, 12, 13, 14, 15, 16, 17, 18, 19, 20, 25, 30, 35, 40, 45, or 50. For example, a nonwoven fabric can have a basis weight of 0.85 osy, 1 osy, 2 osy, 3 osy, 3.1 osy, 4 osy, about 0.85 osy, about 1 osy, about 2 osy, about 3 osy, about 3.1 osy, or about 4 osy. In particular embodiments, a nonwoven fabric can have a basis weight of no more than 4 osy, no more than 3.1 osy, no more than 3 osy, or no more than 0.85 osy. In other embodiments, a nonwoven fabric can have a basis weight of at least 4 osy, at least 3.1 osy, at least 3 osy, or at least 0.85 osy.

A nonwoven fabric used in a silt retention fence system can have a thickness of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in mils, where 1 mil=0.001 inch=0.0254 mm): 0.1, 0.2, 0.3, 0.4, 0.5, 0.6, 0.7, 0.8, 0.9, 1, 2, 3, 4, 5, 6, 7, 8, 9, 10, 10.8, 11, 12, 13, 14, 15, 16, 17, 18, 19, 20, 21, 22, 22.3, 24, 25, 26, 27, 28, 29, 30, 35, 40, 45, 50, 55, 60, 65, 70, 75, 80, 85, 90, 95, 100, 110, 120, 130, 140, 150, 160, 170, 180, 190, 200, 225, 250, 275, 300, 350, 400, 450, or 500. For example, a nonwoven fabric can have a thickness of about 10.8 mils, about 19 mils, or about 22.3 mils. In particular embodiments, a nonwoven fabric can have a thickness of no more than 10.8 mils, no more than 19 mils, or no more than 22.3 mils. In other embodiments, a nonwoven fabric can have a thickness of at least 10.8 mils, at least 19 mils, or at least 22.3 mils.

A nonwoven fabric used in a silt retention fence system can have a machine direction grab tensile strength, as measured using ASTM D5034, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in pounds force ($lb_f$): 1, 2, 3, 4, 5, 6, 7, 8, 9, 10, 11, 12, 13, 14, 15, 16, 17, 18, 19, 19.6, 20, 20.8, 21, 21.1, 21.8, 21.9, 22, 22.45, 23, 24, 25, 26, 27, 28, 29, 30, 35, 40, 45, 50, 55, 60, 65, 70, 75, 80, 85, 90, 95, 100, 105, 110, 115, 120, 125, 130, 132, 135, 140, 145, 150, 155, 157, 160, 165, 170, 175, 180, 185, 190, 195, 200, 225, 250, 275, 300, 350, 400, 450, 500, 550, 600, 650, 700, 750, 800, 850, 900, 950, 1000, 1100, 1200, 1300, 1400, 1500, or 2000. For example, a nonwoven fabric can have a machine direction grab tensile strength, as measured using ASTM D5034, of about 115 lbf, about 132 lbf, or about 157 lbf. In particular embodiments, a nonwoven fabric can have a machine direction grab tensile strength, as measured using ASTM D5034, of at least 115 lbf, at least 132 lbf, or at least 157 lbf.

A nonwoven fabric used in a silt retention fence system can have a machine direction grab elongation, as measured using ASTM D5034, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values given are in %): 5, 10, 15, 20, 25, 30, 35, 40, 45, 50, 55, 60, 65, 70, 70.9, 75, 80, 81, 82, 83, 84, 85, 86, 87, 88, 89, 90, 91, 92, 93, 94, 95, 96, 97, 98, 99, 99.5, 100, 110, 120, 130, 140, 150, 160, 170, 180, 190, or 200. For example, a nonwoven fabric can have a machine direction grab elongation, as measured using ASTM D5034, of about 70.9%, about 84%, or about 91%. In particular embodiments, a nonwoven fabric can have a machine direction grab elongation, as measured using ASTM D5034, of at least 70.9%, at least 84%, or at least 91%.

A nonwoven fabric used in a silt retention fence system can have a cross direction grab tensile strength, as measured using ASTM D5034, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in $lb_f$): 1, 2, 3, 4, 5, 6, 7, 8, 9, 10, 15, 20, 25, 30, 35, 40, 45, 50, 55, 60, 65, 70, 75, 80, 85, 86, 87.5, 90, 95, 100, 105, 110, 115, 119, 120, 125, 130, 132, 135, 140, 145, 150, 155, 157, 160, 165, 170, 175, 180, 185, 190, 195, 200, 225, 250, 275, 300, 350, 400, 450, 500, 550, 600, 650, 700, 750, 800, 850, 900, 950, 1000, 1100, 1200, 1300, 1400, 1500, or 2000. For example, a nonwoven fabric can have a cross direction grab tensile strength, as measured using ASTM D5034, of about 86 lbf, about 87.5 lbf, or about 119 lbf. In particular embodiments, a nonwoven fabric can have a cross direction grab tensile strength, as measured using ASTM D5034, of at least 86 lbf, at least 87.5 lbf, or at least 119 lbf.

A nonwoven fabric used in a silt retention fence system can have a cross direction grab elongation, as measured using ASTM D5034, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values given are in %): 5, 10, 15, 20, 25, 30, 35, 40, 45, 50, 55, 60, 65, 70, 72, 75, 80, 81, 82, 83, 84, 85, 86, 87, 88, 89, 90, 91, 92, 93, 94, 95, 96, 97, 98, 99, 99.5, 100, 110, 120, 130, 140, 150, 160, 170, 180, 190, or 200. For example, a nonwoven fabric can have a cross direction grab elongation, as measured using ASTM D5034, of about 72%, about 94%, or about 100%. In particular embodiments, a nonwoven fabric can have a cross direction grab elongation, as measured using ASTM D5034, of at least 72% or at least 94%.

A nonwoven fabric used in a silt retention fence system can have a machine direction trapezoidal tear strength, as measured using ASTM D5587, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in $lb_f$): 1, 2, 3, 4, 5, 6, 7, 8, 9, 10, 15, 15.3, 20, 25, 30, 35, 40, 45, 49, 50, 55, 60, 65, 70, 75, 80, 85, 86, 87.5, 90, 95, 100, 105, 110, 115, 119, 120, 125, 130, 132, 135, 140, 145, 150, 155, 157, 160, 165, 170, 175, 180, 185, 190, 195, 200, 225, 250, 275, 300, 350, 400, 450, 500, 550, 600, 650, 700, 750, 800, 850, 900, 950, 1000, 1100, 1200, 1300, 1400, 1500, or 2000. For example, a nonwoven fabric can have a machine direction trapezoidal tear strength, as measured using ASTM D5587, of about 15.3 lbf, about 35 lbf, or about 49 lbf. In particular embodiments, a nonwoven fabric can have a machine direction trapezoidal tear strength, as measured using ASTM D5587, of at least about 15.3 lbf, at least about 35 lbf, or at least about 49 lbf.

A nonwoven fabric used in a silt retention fence system can have a cross direction trapezoidal tear strength, as measured using ASTM D5587, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in $lb_f$): 1, 2, 3, 4, 5, 6, 7, 8, 9, 10, 15, 20, 24, 25, 26.9, 30, 34.2, 35, 40, 45, 49, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 225, 250, 275, 300, 350, 400, 450, 500, 550, 600, 650, 700, 750, 800, 850, 900, 950, 1000, 1100, 1200, 1300, 1400, 1500, or 2000. For example, a nonwoven fabric can have a cross direction trapezoidal tear strength, as measured using ASTM D5587, of about 24 lbf, about 26.9 lbf, or about 34.2 lbf. In particular embodiments, a nonwoven fabric can have a cross direction trapezoidal tear strength, as measured using ASTM D5587, of at least about 24 lbf, at least about 26.9 lbf, or at least about 34.2 lbf.

A nonwoven fabric used in a silt retention fence system can have a mean pore size of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in microns): 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 28.2, 29, 30, 31, 32, 33, 34, 35, 36, 37, 38, 39, 40, 41, 45, 50, 55, 60, 65, 70, 75, 80, 85, 90, 95, 100, 110, 120, 130, 140, 150, 160, 170, 180, 190, or 200. For example, a nonwoven fabric can have a mean pore size of 28.2 microns, about 28.2 microns, at least 28.2 microns, no more than 28.2 microns, 31 microns, about 31 microns, at least 31 microns, no more than 31 microns, or no more than 41 microns.

Mean pore size can be measured by any suitable method known in the art. For example, the mean pore size can be measured using an instrument as discussed in a publication by Jena et al. (Jena, A. and Gupta, K., Advances in Pore Structure Evaluation by Porometry, Porous Materials Inc., http://www.pmiapp.com/publications/docs/Review-Papers/Advances-in-Pore-Structure-Evaluation-by-Porometry.pdf), which is hereby incorporated by reference in its entirety.

A nonwoven fabric used in a silt retention fence system can have an air permeability, as measured using ASTM D737, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in cubic feet per minute per square foot): 10, 20, 30, 40, 50, 60, 70, 80, 90, 92.5, 100, 110, 120, 125, 130, 140, 150, 160, 170, 180, 185, 190, 195, 200, 225, 250, 275, 300, 350, 400, 450, 500, 550, 600, 650, 700, 750, 800, 850, 900, 950, or 1000. For example, a nonwoven fabric can have an air permeability, as measured using ASTM D737, of about 92.5 cubic feet per minute per square foot, about 125 cubic feet per minute per square foot, or about 190 cubic feet per minute per square foot. In particular embodiments, a nonwoven fabric can have an air permeability, as measured using ASTM D737, of at least about 92.5 cubic feet per minute per square foot, at least about 125 cubic feet per minute per square foot, or at least about 190 cubic feet per minute per square foot. In particular embodiments, a nonwoven fabric can have an air permeability, as measured using ASTM D737, of no more than 92.5 cubic feet per minute per square foot, no more than 125 cubic feet per minute per square foot, or no more than 190 cubic feet per minute per square foot.

A nonwoven fabric used in a silt retention fence system can have a machine direction grab tensile strength, as measured using ASTM D4632, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in $lb_f$): 1, 2, 3, 4, 5, 6, 7, 8, 9, 10, 15, 20, 24, 25, 30, 35, 40, 45, 49, 50, 55, 60, 65, 70, 75, 80, 85, 90, 95, 100, 105, 110, 115, 120, 125, 130, 135, 140, 145, 150, 155, 160, 165, 170, 171, 172, 173, 174, 175, 176, 177, 178, 179, 180, 185, 190, 195, 200, 225, 250, 275, 300, 350, 400, 450, 500, 550, 600, 650, 700, 750, 800, 850, 900, 950, 1000, 1100, 1200, 1300, 1400, 1500, or 2000. For example, a nonwoven fabric can have machine direction grab tensile strength, as measured using ASTM D4632, of 174 lbf or about 174 lbf. In particular embodiments, a nonwoven fabric can have machine direction grab tensile strength, as measured using ASTM D4632, of at least 174 lbf.

A nonwoven fabric used in a silt retention fence system can have a machine direction grab elongation, as measured using ASTM D4632, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values given are in %): 5, 10, 15, 20, 25, 30, 35, 40, 45, 50, 55, 60, 65, 70, 72, 75, 80, 81, 82, 83, 84, 85, 86, 87, 88, 89, 90, 91, 92, 93, 94, 95, 96, 97, 98, 99, 99.5, 100, 110, 111, 112, 113, 114, 115, 116, 117, 118, 119, 120, 130, 140, 150, 160, 170, 180, 190, or 200. For example, a nonwoven fabric can have a machine direction grab elongation, as measured using ASTM D4632, of 115% or about 115%. In particular embodiments, a nonwoven fabric can have a machine direction grab elongation, as measured using ASTM D4632, of at least 115%.

A nonwoven fabric used in a silt retention fence system can have a cross direction grab tensile strength, as measured using ASTM D4632, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in $lb_f$): 1, 2, 3, 4, 5, 6, 7, 8, 9, 10, 15, 20, 24, 25, 30, 35, 40, 45, 49, 50, 55, 60, 65, 70, 75, 80, 85, 90, 95, 100, 105, 110, 115, 120, 121, 122, 123, 124, 125, 126, 127, 128, 129, 130, 135, 140, 145, 150, 155, 160, 165, 170, 171, 172, 173, 174, 175, 176, 177, 178, 179, 180, 185, 190, 195, 200, 225, 250, 275, 300, 350, 400, 450, 500, 550, 600, 650, 700, 750, 800, 850, 900, 950, 1000, 1100, 1200, 1300, 1400, 1500, or 2000. For example, a nonwoven fabric can have cross direction grab tensile strength, as measured using ASTM D4632, of 126 lbf or about 126 lbf. In particular embodiments, a nonwoven fabric can have cross direction grab tensile strength, as measured using ASTM D4632, of at least 126 lbf.

A nonwoven fabric used in a silt retention fence system can have a cross direction grab elongation, as measured using ASTM D4632, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values given are in %): 5, 10, 15, 20, 25, 30, 35, 40, 45, 50, 55, 60, 65, 70, 72, 75, 80, 81, 82, 83, 84, 85, 86, 87, 88, 89, 90, 91, 92, 93, 94, 95, 96, 97, 98, 99, 99.5, 100, 110, 111, 112, 113, 114, 115, 116, 117, 118, 119, 120, 130, 140, 150, 160, 170, 180, 190, or 200. For example, a nonwoven fabric can have a cross direction grab elongation, as measured using ASTM D4632, of 112% or about 112%. In particular embodiments, a nonwoven fabric can have a cross direction grab elongation, as measured using ASTM D5034, of at least 112%.

A nonwoven fabric used in a silt retention fence system can have a flux rate, or function to filter water with a flux rate, as measured by ASTM D5141, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in gallons per minute per square foot ($gpm/ft^2$)): 0.01, 0.02, 0.03, 0.04, 0.05, 0.06, 0.07, 0.1, 0.2, 0.3, 0.4, 0.5, 0.6, 0.7, 0.8, 0.9, 0.91, 0.92, 0.93, 0.94, 0.95, 0.96, 0.97, 0.98, 0.99, 1.0, 1.05, 1.10, 1.15, 1.19, 1.20, 1.21, 1.25, 1.3, 1.4, 1.5, 1.75, 2.0, 2.5, 3.0, 3.5, 4.0, 5, 6, 7, 8, 9, 10, 15, 20, 25, or 30. For example, a nonwoven fabric can have can have a flux rate, or function to filter water with a flux rate, as measured by ASTM D5141, of 0.91 $gpm/ft^2$, about 0.91 $gpm/ft^2$, 0.94 $gpm/ft^2$, about 0.94 $gpm/ft^2$, 0.96 $gpm/ft^2$, about 0.96 $gpm/ft^2$, 1.2 $gpm/ft^2$, or about 1.2 $gpm/ft^2$. In particular embodiments, a nonwoven fabric can have can have a flux rate, or function to filter water with a flux rate, as measured by ASTM D5141, of at least 0.91 $gpm/ft^2$, at least 0.94 $gpm/ft^2$, at least 0.96 $gpm/ft^2$, or at least 1.2 $gpm/ft^2$.

A nonwoven fabric used in a silt retention fence system can have a filter efficiency (e.g., as measured by ASTM D5141) of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values given are in %): 5, 10, 15, 20, 25, 30, 35, 40, 45, 50, 55, 60, 65, 70, 75, 80, 85, 86, 90, 91, 92, 93, 94, 95, 96, 97, 98, 99, 99.1, 99.2, 99.3, 99.4, 99.5, 99.6, 99.7, 99.8, 99.9, 99.91, 99.92, 99.93, 99.94, 99.95, 99.96, 99.97, 99.98, 99.99, or 100. For example, a nonwoven fabric can have a filter efficiency, as measured by ASTM D5141, of 99%, about 99%, at least 99%, 99.1%, about 99.1%, at least 99.1%, 99.3%, about 99.3%, at least 99.3%, 99.5%, about 99.5%, or at least 99.5%. In a particular embodiment, a nonwoven fabric can have a filter efficiency, as measured by ASTM D5141, of at least 99%. A nonwoven fabric can have a filter efficiency, as measured by ASTM D5141, of any of the following values or ranges as discussed in this paragraph even when filtering fluid (e.g., water) at a flux rate of any of the values or ranges as discussed in the previous paragraph (e.g., at least 0.91 gpm/$ft^2$, at least 0.94 gpm/$ft^2$, at least 0.96 gpm/$ft^2$, or at least 1.2 gpm/$ft^2$).

The protocol for ASTM D5141 used to measure the filter efficiency and flux rate is described in detail in a publication by Wolfe et al. (Wolfe, K. B. and Peters, J. L., Qualitative Valuation of Performance Testing for Sediment Retention Devices, International Erosion Control Association, http://www.ieca.org/membersonly/cms/content/Proceedings/Object463PDFEnglish.pdf), which is hereby incorporated by reference in its entirety.

A nonwoven fabric used in a silt retention fence system can have a density of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values are in grams per cubic centimeter (g/cc)): 0.01, 0.05, 0.1, 0.15, 0.2, 0.21, 0.22, 0.23, 0.231, 0.232, 0.234, 0.235, 0.236, 0.237, 0.238, 0.239, 0.24, 0.25, 0.30, 0.31, 0.32, 0.33, 0.34, 0.35, 0.36, 0.37, 0.38, 0.39, 0.4, 0.5, 0.6, 0.7, 0.8, 0.9, 1, 1.5, 2, 2.5, 3, 3.5, 4, 5, 10, 15, or 20. For example, a nonwoven fabric can have can have a density of 0.234 g/cc, about 0.234 g/cc, at least 0.234 g/cc, 0.2 g/cc, about 0.2 g/cc, or at least 0.2 g/cc.

A nonwoven fabric used in a silt retention fence system can have a retention of its machine direction grab strength, as measured using ASTM D5034, after exposure to a xenon light source for a long period of time, of, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values given are in %): 50, 55, 60, 65, 70, 70.9, 75, 80, 81, 82, 83, 84, 85, 86, 87, 88, 89, 90, 91, 92, 93, 94, 95, 96, 97, 98, 99, 99.5, or 100. The amount of time the nonwoven fabric can be exposed to the xenon light source can be, for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values given are in hours): 100, 200, 300, 400, 500, 600, 700, 800, 900, 1000, 1100, 1200, 1300, 1400, 1500, 1600, 1700, 1800, 1900, or 2000. For example, a nonwoven fabric can have a retention of its machine direction grab strength, as measured using ASTM D5034, after exposure to a xenon light source for 1000 hours, of about 87% or at least about 87%.

A nonwoven fabric used in a silt retention fence system can have a Mullen burst strength of, for example, at least 79 pounds per square inch (psi).

In many embodiments, a nonwoven fabric used in a silt retention fence system can have absorption of at least about twice its weight in oil. In various embodiments, a nonwoven fabric used in a silt retention fence system can have absorption of at least two times (×), at least 1.0×, at least 1.1×, at least 1.2×, at least 1.3×, at least 1.4×, at least 1.5×, at least 1.6×, at least 1.7×, at least 1.8×, at least 1.9×, at least 2.1×, at least 2.2×, at least 2.3×, at least 2.4×, at least 2.5×, at least 3×, at least 4×, at least 5×, at least 6×, at least 7×, at least 8×, at least 9×, at least 10×, at least 11×, at least 12×, at least 13×, at least 14×, at least 15×, or more of its own body weight in oil. The viscosity for the oil for which the fabric can absorb these amounts can be for example, any of the following values, about any of the following values, at least any of the following values, at least about any of the following values, not more than any of the following values, not more than about any of the following values, or within any range having any of the following values as endpoints (with or without "about" in front of one or both of the endpoints), though embodiments are not limited thereto (all numerical values given are in centipoise (cp)): 50, 100, 150, 200, 250, 300, 320, 350, 400, 450, 500, 550, or 600. For example, a nonwoven fabric used in a silt retention fence system can have absorption of at least about twice its weight in oil having a viscosity of about 320 cp.

A nonwoven fabric used in a silt retention fence system can be made of a variety of materials, for example, nylon (e.g., nylon 6, nylon 6,6, etc.), polyester, or polypropylene, though embodiments are not limited thereto. In many embodiments, the fabric does not require reinforcement to perform in the field when fabricated into a silt retention fence.

In an embodiment, the fabric can be bonded (e.g., thermally bonded) with the pattern illustrated in registered United States Trademark 2,163,116, which is hereby incorporated by reference in its entirety. This fabric is sold under the trademarks PBN-II® and OIL SHARK® and is available from Cerex Advanced Fabrics, Inc., of Cantonment, Fla., U.S.A. Other patterns can be used. Examples of fabrics that can be used with other patterns include a diamond-patterned fabric sold under the trademarks ORION® and OIL SHARK® available from Cerex Advanced Fabrics, Inc. and a herringbone-patterned fabric sold under the trademarks SPECTRAMAX® and OIL SHARK® available from Cerex Advanced Fabrics, Inc., though embodiments are not limited thereto.

A nonwoven fabric used in a silt retention fence system can have any combination of the properties discussed herein.

In an embodiment, a strong nonwoven fabric that does not tear easily, with no internal or external reinforcement, and that retains at least 87% of its strength when exposed to a xenon light source for 1000 hours can be used as part of a silt retention system. The strong nonwoven fabric will retain at least twice its weight in oil and will not break down when exposed to oil, gasoline, Diesel fuel, hydrocarbons, or other petroleum products. The light stability of the fabric can be improved by adding light stabilizers and light blockers or both to the spinning system, or by topically treating the fabric so that the fabric retains at least 96% of its strength when exposed to a xenon light source for 1000 hours. In certain embodiments, the fabric can be either post-dyed or dyed during the spinning process by adding dyes or pigments into the spinning system to create a highly visible silt retention fence that serves the dual purpose of a warning barrier, eliminating the need for a second warning barrier fence. In a particular embodiment, thicker edges and/or bands in the machine direction can be easily sewn into the sheet by folding the fabric in the machine direction if so desired to increase the strength in specific areas across the sheet. Many different strong nonwoven fabrics with a variety or combination of enhanced features can be used as long as they are configured to meet the requirements of the field application.

In an embodiment, a strong nonwoven fabric can be used to provide an erosion control sheet made of a single nonwoven fabric with no reinforcement that does not tear during installation or when holding back the flow of water, debris or silt. In a particular embodiment, such a fabric can have a basis weight of about 3 ounces per square yard, a thickness of about 19 mils, a machine direction grab tensile strength of about 115 $lb_f$ as measured using ASTM D5034, a machine direction grab elongation of about 84% as measured using ASTM D5034, a cross direction grab tensile strength of about 86 $lb_f$ as measured using ASTM D5034, a cross direction grab elongation of about 94% as measured using ASTM D5034, a machine direction trapezoidal tear strength of at least about 35 $lb_f$ as measured by ASTM D5587, a cross direction trapezoidal tear strength of at least about 24 $lb_f$ as measured by ASTM D5587, air permeability of at least about 190 cubic feet per minute per square foot as measured by ASTM D737, retention of at least about 87% of its machine direction grab strength as measured using ASTM D5034 when exposed to a xenon light source for 1000 hours, continuous nylon filaments, and absorption of at least about twice its weight in oil having a viscosity of about 320 centipoises. Other polymers can be used to make the fabric including but not limited to polyester and polypropylene, as long as the fabric can be used without reinforcement to perform in the field when fabricated into a silt retention fence. The fabric can be thermally bonded with the pattern illustrated in registered United States Trademark 2,163,116. This fabric is sold under the trademarks PBN-II® and OIL SHARK® and is available from Cerex Advanced Fabrics, Inc. Other patterns can be used. Examples of fabrics that can be used with other patterns are a diamond-patterned fabric sold under the trademarks ORION® and OIL SHARK® available from Cerex Advanced Fabrics, Inc. and a herringbone-patterned fabric sold under the trademarks SPECTRAMAX® and OIL SHARK® available from Cerex Advanced Fabrics, Inc.

In certain embodiments, the top edge of the fabric can be folded over at least once and at least one seam can be sewn into it to provide a stronger edge to fasten stakes or other supporting hardware to the fabric. As many folds and/or seams as may be desired can be included. It is also possible to sew a pocket seam on the top edge of the fabric to accommodate the top of a stake. If not at an edge, any number of even folds can be made parallel to the ground to provide a thicker, stronger section to fasten the stakes or other apparatus if so desired. At least one fold can also be made at the bottom edge and slits can be cut into the edge to slide stakes or other hardware used to install the system in the ground. As many bottom edge folds and/or slits as may be desired can be included.

In a particular embodiment, a strong nonwoven fabric can be used to provide an erosion control sheet made of a single nonwoven fabric with no reinforcement that does not tear during installation or when holding back the flow of water, debris or silt. The nonwoven fabric can have a basis weight of 4 ounces per square yard, a thickness of about 22.3 mils, a machine direction grab tensile strength of about 157 $lb_f$ as measured using ASTM D5034, a machine direction grab elongation of about 91% as measured using ASTM D5034, a cross direction grab tensile strength of about 119 $lb_f$ as measured using ASTM D5034, a cross direction grab elongation of about 100% as measured using ASTM D5034, a machine direction trapezoidal tear strength of at least about 49 $lb_f$ as measured by ASTM D5587, a cross direction trapezoidal tear strength of at least about 34.2 $lb_f$ measured by ASTM D5587, air permeability of at least about 125 cubic feet per minute per square foot as measured by ASTM D737, retention of at least about 87% of its machine direction grab strength as measured using ASTM D5034 when exposed to a xenon light source for 1000 hours, continuous nylon filaments, and absorption of at least about twice its weight in oil having a viscosity of about 320 centipoises. Additionally, the fabric can have a machine direction grab tensile strength of about 174 $lb_f$ as measured using ASTM D4632, a machine direction grab elongation of about 115% as measured using ASTM D4632, a cross direction grab tensile strength of about 126 $lb_f$ as measured using ASTM D4632, a cross direction grab elongation of about 112% as measured using ASTM D4632, a mean pore size of about 31 microns, a filter efficiency of at least 99% (e.g., 99.1%, 99.3%, 99.5%) as measured by ASTM D5141. The fabric can have a flux rate, or function to filter water with a flux rate, of at least 0.91 gallons per minute per square foot as measured by ASTM D5141. The fabric can have a filter efficiency of at least 99% as measured by ASTM D5141 when filtering water at a flux rate of at least 0.91 gallons per minute per square foot as measured by ASTM D5141. The density of this fabric can be 0.234 grams per cubic centimeter.

Other polymers or combinations of polymers can be used to make the fabric including but not limited to polyester and polypropylene, as long as the fabric can be used without reinforcement to perform in the field when fabricated into a silt retention fence. The fabric can be thermally bonded with the pattern illustrated in registered United States Trademark 2,163,116. This fabric is sold under the trademarks PBN-II® and OIL SHARK® and is available from to Cerex Advanced Fabrics, Inc. Other patterns can be used. Examples of fabrics that can be used with other patterns are a diamond-patterned fabric sold under the trademarks ORION® and OIL SHARK® available from Cerex Advanced Fabrics, Inc. and a herringbone-patterned fabric sold under the trademarks SPECTRAMAX® and OIL SHARK® available from Cerex Advanced Fabrics, Inc.

In a particular embodiment, a combination of a solvent red dye and a solvent orange dye can be added to a nylon extrusion system to make a strong nonwoven fabric with a high visibility color (orange or orange-ish) that can be used to provide an erosion control sheet made of a single nonwoven fabric with no reinforcement that does not tear during installation or when holding back the flow of water, debris, or silt. Such a fabric is highly visible. The nonwoven fabric can have a basis weight of about 4 ounces per square yard, a thickness of about 22.9 mils, a machine direction grab tensile strength of at least about 150 $lb_f$ as measured using ASTM D5034, a machine direction grab tensile strength of at least about 174 $lb_f$ as measured using ASTM D4632, a machine direction grab elongation of about 90% as measured using ASTM D5034, a machine direction grab elongation of about 115% as measured using ASTM D4632, a cross direction grab tensile strength of at least about 119 $lb_f$ as measured using ASTM D5034, a cross direction grab tensile strength of at least about 126 $lb_f$ as measured using ASTM D4632, a cross direction grab elongation of about 99% as measured using ASTM D5034, a cross direction grab elongation of about 112% as measured using ASTM D4632, a machine direction trapezoidal tear strength of at least about 41 $lb_f$ as measured by ASTM D5587, a cross direction trapezoidal tear strength of at least about 26 $lb_f$ measured by ASTM D5587, air permeability of about 98 cubic feet per minute per square foot as measured by ASTM D737, a mean pore size of about 31 microns, a filter efficiency of at least 99% as measured by ASTM D5141, retention of at least about 87% of its machine direction grab strength as measured using ASTM D5034 when exposed to a xenon light source for 1000 hours, a machine direction tensile strength of at least about 45 $lb_f$ after 500 hours of exposure to a xenon light source and water spray as described in ASTM D4355-07 and as measured using ASTM D4355-07, retention of at least about 30% of its original machine direction tensile strength after 500 hours of exposure to a xenon light source and water spray as described in ASTM D4355-07 and as measured using ASTM D4355-07, a cross direction tensile strength of at least about 28 $lb_f$ after 500 hours of exposure to a xenon light source and water spray as described in ASTM D4355-07 and as measured using ASTM D4355-07, retention of at least about 29% of its original cross direction tensile strength after 500 hours of exposure to a xenon light source and water spray as described in ASTM D4355-07 and as measured using ASTM D4355-07, a machine direction elongation of at least about 24% after 500 hours of exposure to a xenon light source and water spray as described in ASTM D4355-07 and as measured using ASTM D4355-07, retention of at least about 20% of its original machine direction elongation after 500 hours of exposure to a xenon light source and water spray as described in ASTM D4355-07 and as measured using ASTM D4355-07, a cross direction elongation of at least about 29% after 500 hours of exposure to a xenon light source and water spray as described in ASTM D4355-07 and as measured using ASTM D4355-07, retention of at least about 22% of its original cross direction elongation after 500 hours of exposure to a xenon light source and water spray as described in ASTM D4355-07 and as measured using ASTM D4355-07, continuous nylon filaments, and absorption of at least about twice its weight in oil having a viscosity of about 320 centipoises. The fabric can have a flux rate, or function to filter water with a flux rate, of at least 0.91 gallons per minute per square foot as measured by ASTM D5141. The fabric can have a filter efficiency of at least 99% as measured by ASTM D5141 when filtering water at a flux rate of at least 0.91 gallons per minute per square foot as measured by ASTM D5141. The density of this fabric can be 0.234 grams per cubic centimeter.

The nonwoven fabric can originally have an orange color close to Pantone® 159C. The fabric can retain its orange color and become a lighter orange color close to or darker than Pantone® 472C after 500 hours of exposure to a xenon light source and water spray as described in ASTM D4355-07. Other polymers or combinations of polymers can be used to make the fabric including but not limited to polyester and polypropylene, as long as the fabric can be used without reinforcement to perform in the field when fabricated into a silt retention fence. The fabric can be thermally bonded with the pattern illustrated in registered United States Trademark 2,163,116. This fabric is sold under the trademarks PBN-II® and OIL SHARK® and is available from Cerex Advanced Fabrics, Inc., though embodiments are not limited thereto. Other patterns can be used. Examples of fabrics that can be used with other patterns are a diamond-patterned fabric sold under the trademarks ORION® and OIL SHARK® available from Cerex Advanced Fabrics, Inc. and a herringbone-patterned fabric sold under the trademarks SPECTRAMAX® and OIL SHARK® available from Cerex Advanced Fabrics, Inc.

In many embodiments, a fabric can include a UV stabilizer or blocker. Such a UV stabilizer or blocker can be added to a nylon extrusion system for the fabric. The UV stabilizer or blocker can be, for example, the UV stabilizer (blocker) sold under the trade name Cesa Light 7725™ from Clariant®, though embodiments are not limited thereto.

In an embodiment, a combination of a solvent red dye, a solvent orange dye, and UV stabilizers or blockers or both can be added to a nylon extrusion system to make a strong nonwoven fabric that is highly visible (e.g., orange or orange-ish) that can be used to provide an erosion control sheet made of a single nonwoven fabric with no reinforcement that does not tear during installation or when holding back the flow of water, debris or silt. The fabric can be highly visible and can maintain a machine direction tensile strength of at least about 78 $lb_f$ and a cross direction tensile strength of at least about 55 $lb_f$ after 300 hours of exposure to a xenon light source and a water spray as described and measured by ASTM D4355. The fabric can maintain a machine direction tensile strength of at least about 56 $lb_f$ and a cross direction tensile strength of at least about 38 $lb_f$ after 500 hours of exposure to a xenon light source and a water spray as described and measured by ASTM D 4355-07. The fabric can have a machine direction elongation of about 83% and a cross direction elongation of about 81% after 300 hours of exposure to a xenon light source and a water spray as described and measured by ASTM D 4355. The fabric can have a machine direction elongation of about 57% and a cross direction elongation of about 72% after 500 hours of exposure to a xenon light source and a water spray as described and measured by ASTM D 4355. The acceptable lower limits on strength after the 500 hour exposure test described in ASTM D4355-07 will depend on the application of the silt fence or a specification for a silt fence. The nonwoven fabric can have a basis weight of about 4 ounces per square yard, a thickness of about 21 to 23 mils, a machine direction grab tensile strength of at least about 150 $lb_f$ as measured using ASTM D5034, a machine direction grab tensile strength of at least about 174 as measured using ASTM D4632, a machine direction grab to elongation of about 92 to 97% as measured using ASTM D5034, a machine direction grab elongation of about 115% as measured using ASTM D4632, a cross direction grab tensile strength of at least about 118 $lb_f$ as measured using ASTM D5034, a cross direction grab tensile strength of at least about 126 $lb_f$ as measured using ASTM D4632, a cross direction grab elongation of about 95-98% as measured using ASTM D5034, a cross direction grab elongation of about 112% as measured using ASTM D4632, a machine direction trapezoidal tear strength of at least about 35 $lb_f$ as measured by ASTM D5587, a cross direction trapezoidal tear strength of at least about 25 $lb_f$ measured by ASTM D5587, air permeability of about 101 to 107 cubic feet per minute per square foot as measured by ASTM D737, a mean pore size of about 31 microns, a filter efficiency of at least 99% as measured by ASTM D5141, retention of at least about 87% of its machine direction grab strength as measured using ASTM D5034 when exposed to a xenon light source for 1000 hours, continuous nylon filaments, and absorption of at least about twice its weight in oil having a viscosity of about 320 centipoises. The nonwoven fabric can originally have an orange color close to Pantone® 159C. The fabric can retain its orange color and become a lighter orange color close to Pantone® 1575C after 500 hours of exposure to a xenon light source and water spray as described in ASTM D4355. The fabric can have a flux rate, or function to filter water with a flux rate, of at least 0.91 gallons per minute per square foot as measured by ASTM D5141. The fabric can have a filter efficiency of at least 99% as measured by ASTM D5141 when filtering water at a flux rate of at least 0.91 gallons per minute per square foot as measured by ASTM D5141. The density of the fabric can be, e.g., about 0.234 grams per cubic centimeter.

Other polymers or combinations of polymers can be used to make the fabric including but not limited to polyester and polypropylene, as long as the fabric can be used without reinforcement to perform in the field when fabricated into a silt retention fence. The fabric can be thermally bonded with the pattern illustrated in registered United States Trademark 2,163,116. This fabric is sold under the trademarks PBN-II® and OIL SHARK® and is available from Cerex Advanced Fabrics, Inc. Other patterns can be used. Examples of fabrics that can be used with other patterns are a diamond-patterned fabric sold under the trademarks ORION® and OIL SHARK® available from Cerex Advanced Fabrics, Inc. and a herringbone-patterned fabric sold under the trademarks SPECTRAMAX® and OIL SHARK® available from Cerex Advanced Fabrics, Inc.

In certain embodiments, the top edge of the fabric can be folded over at least once and at least one seam can be sewn into it to provide a stronger edge to fasten stakes or other supporting hardware to the fabric. As many folds and/or seams as may be desired can be included. It is also possible to sew a pocket seam on the top edge of the fabric to accommodate the top of a stake. If not at an edge, any number of even folds can be made parallel to the ground to provide a thicker, stronger section to fasten the stakes or other apparatus if so desired. At least one fold can also be made at the bottom edge and slits can be cut into the edge to slide stakes or other hardware used to install the system in the ground. As many bottom edge folds and/or slits as may be desired can be included.

In an embodiment, a strong nonwoven fabric can be used to provide an erosion control sheet made of a single sheet of non-reinforced nonwoven fabric that does not tear during installation or when holding back the flow of water, debris, or silt. The fabric can have a basis weight of about 3.1 ounces per square yard, a thickness of about 10.8 mils, a machine direction grab tensile strength of about 132 $lb_f$ as measured using ASTM D5034, a machine direction grab elongation of about 70.9% as measured using ASTM D5034, a cross direction grab tensile strength of about 87.5 $lb_f$ as measured using ASTM D5034, a cross direction grab elongation of about 72% as measured using ASTM D5034, a mean pore size of about 28.2 microns, a machine direction trapezoidal tear strength of at least about 15.3 $lb_f$ as measured by ASTM D5587, a cross direction trapezoidal tear strength of at least about 26.9 $lb_f$ as measured by ASTM D5587, air permeability of at least about 92.5 cubic feet per minute per square foot as measured by ASTM D737, retention of at least about 87% of its machine direction grab strength as measured using ASTM D5034 when exposed to a xenon light source for 1000 hours, continuous nylon filaments, and absorption of at least about twice its weight in oil having a viscosity of about 320 centipoises. In a particular embodiment, the fabric can be autogenously bonded using, e.g., anhydrous hydrochloric acid. The fabric is available from Cerex Advanced Fabrics, Inc. and sold under the trademark, CEREX®.

In certain embodiments, the top edge of the fabric can be folded over at least once and at least one seam can be sewn into it to provide a stronger edge to fasten stakes or other supporting hardware to the fabric. As many folds and/or seams as may be desired can be included. It is also possible to sew a pocket seam on the top edge of the fabric to accommodate the top of a stake. If not at an edge, any number of even folds can be made parallel to the ground to provide a thicker, stronger section to fasten the stakes or other apparatus if so desired. At least one fold can also be made at the bottom edge and slits can be cut into the edge to slide stakes or other hardware used to install the system in the ground. As many bottom edge folds and/or slits as may be desired can be included.

In an embodiment, strong nylon spunbonded fabrics can be used to absorb oil from runoff. The nylon fabrics can have any of the properties or combination of properties discussed herein for the nonwoven fabrics used in a silt retention fence system. Nylon is known to be chemically resistant to hydrocarbons, such as gasoline, grease, oil, and Diesel fuel. Other polymers such as polyethylene, polypropylene, and polyesters are not as chemically resistant to petroleum products as nylon is. An environmental risk to surface water and groundwater can occur if a material is used with insufficient resistance to petroleum or hydrocarbon compounds. Suitable spunbonded nylon fabrics are available under the trade names CEREX®, VIBRATEX®, PBN-II®, ORION®, SPECTRALON®, OIL SHARK® and SPECTRAMAX® from Cerex Advanced Fabrics, Inc. in Cantonment, Fla. These nylon fabrics readily absorb oil and are made with continuous filaments providing superior strength and fabric integrity. For example, 2-, 3-, and 4-osy basis weight PBN-II® fabrics have been shown to have excellent performance for separating oil from seawater, as described in Example 9 herein.

In many embodiments, a strong nonwoven fabric can be used with added, novel features to create a silt screen system that has the dual function of a warning barrier by dyeing or printing a highly visible color on the fabric and absorber of at least twice its weight in oil and/or grease, removing these petroleum based pollutants from surface runoff water.

In an embodiment, a method of fabricating a silt retention system can include attaching a nonwoven fabric as described herein to one or more supporting structures, such as stakes. In certain embodiments, the top edge of the fabric can be folded over at least once and at least one to seam can be sewn into it to provide a stronger edge to fasten stakes or other supporting hardware to the fabric. As many folds and/or seams as may be desired can be included. It is also possible to sew a pocket seam on the top edge of the fabric to accommodate the top of a stake. If not at an edge, any number of even folds can be made parallel to the ground to provide a thicker, stronger section to fasten the stakes or other apparatus if so desired. At least one fold can also be made at the bottom edge and slits can be cut into the edge to slide stakes or other hardware used to install the system in the ground. As many bottom edge folds and/or slits as may be desired can be included.

In an embodiment, a method of using a silt retention system can include providing a silt retention system including a nonwoven fabric as described herein. The fabric will function in the silt retention system as desired.

EXEMPLIFIED EMBODIMENTS

The invention includes, but is not limited to, the following embodiments:

Embodiment 1

A silt retention system, comprising a nonwoven fabric having no reinforcement, wherein the nonwoven fabric has an average filter efficiency of at least 93% as measured by ASTM D5141, and a tensile strength of at least about 85 $lb_f$ as measured by ASTM D4632.

Embodiment 2

The silt retention system according to embodiment 1, further comprising at least one supporting structure, wherein the nonwoven fabric is attached to the at least one supporting structure.

Embodiment 3

The silt retention system according to any of embodiments 1-2, wherein the nonwoven fabric passes the criteria for NSF/ANSI Standard 61 and United States Environmental Protection Agency (EPA) SW-846.

Embodiment 4

The silt retention system according to any of embodiments 1-3, wherein the nonwoven fabric comprises an engraved pattern.

Embodiment 5

The silt retention system according to any of embodiments 1-4, wherein the nonwoven fabric comprises a bond area of 17% to 25% of the nonwoven fabric.

Embodiment 6

The silt retention system according to any of embodiments 1-5, wherein the nonwoven fabric has a filter efficiency of at least 93% for a flux rate of at least 0.9 gallons per minute per square foot as measured by ASTM D5141.

Embodiment 7

The silt retention system according to any of embodiments 1-6, wherein the nonwoven fabric has a basis weight in a range of from 1 ounce per square yard (osy) to 12 osy.

Embodiment 8

The silt retention system according to any of embodiments 1-7, wherein the nonwoven fabric has an air permeability of no more than 250 cubic feet per minute per square foot ($ft^3$/minute/$ft^2$).

Embodiment 9

The silt retention system according to any of embodiments 1-8, wherein the nonwoven fabric has a mean pore size of no more than 41 microns.

Embodiment 10

The silt retention system according to any of embodiments 1-11, wherein the nonwoven fabric has a thickness of at least 18 mils and a fabric density of at least 0.18 grams per cubic centimeter (g/cc).

Embodiment 11

The silt retention system according to any of embodiments 1-10, wherein the nonwoven fabric comprises a UV stabilizer, and wherein the nonwoven fabric is adapted to have, after 500 hours of exposure to a xenon light source and water spray according to the protocol described in ASTM D5534 07, a machine direction grab tensile strength of at least 44 $lb_f$ as measured by ASTM D5034, a cross direction grab tensile strength of at least 33 $lb_f$ as measured by ASTM D5034, a machine direction elongation of at least 42% as measured by ASTM D5034, and a cross direction elongation of at least 56% as measured by ASTM D5034.

Embodiment 12

The silt retention system according to any of embodiments 1-11, wherein the nonwoven fabric has an orange shade that is at least as dark as a Pantone 472C after 500 hours of exposure to a xenon light source and water spray according to the protocol described in ASTM D4355 07.

Embodiment 13

The silt retention system according to any of embodiments 1-12, wherein the nonwoven fabric is adapted to separate at least 95% of 320 centipoise (cp) oil from an oil and water emulsion that contains about 4.5% of 320 cp oil as measured according to test method 1664A HEM (Oil and Grease).

Embodiment 14

A method of fabricating a silt retention system, comprising:

forming a nonwoven fabric; and attaching the nonwoven fabric to a supporting structure to form the silt retention system, wherein forming the nonwoven fabric comprises:

forming, in an extruder, a master batch comprising at least one polymer;

extruding the master batch in the form of a plurality of filaments, depositing the filaments onto a collection surface to form a web, and thermally bonding the filaments of the web to form the nonwoven fabric, wherein the nonwoven fabric has an average filter efficiency of at least 93% as measured by ASTM D5141, and a tensile strength of at least about 85 $lb_f$ as measured by ASTM D4632.

Embodiment 15

The method according to embodiment 14, wherein the nonwoven fabric passes the criteria for NSF/ANSI Standard 61 and United States EPA SW-846.

Embodiment 16

The method according to any of embodiments 14-15, wherein forming the nonwoven fabric further comprises adding a UV stabilizer to the master batch before extruding the master batch, and wherein the nonwoven fabric is adapted to have, after 500 hours of exposure to a xenon light source and water spray according to the protocol described in ASTM D5534 07, a machine direction grab tensile strength of at least 44 $lb_f$ as measured by ASTM D5034, a cross direction grab tensile strength of at least 33 $lb_f$ as measured by ASTM D5034, a machine direction elongation of at least 42% as measured by ASTM D5034, and a cross direction elongation of at least 56% as measured by ASTM D5034.

Embodiment 17

The method according to any of embodiments 14-16, wherein the nonwoven fabric comprises a thermal bond area of 17% to 25% of the area of the nonwoven fabric, and wherein forming the nonwoven fabric further comprises engraving the fabric to form an engraved pattern.

Embodiment 18

The method according to any of embodiments 14-17, wherein the nonwoven fabric has an air permeability of no more than 250 $ft^3$/minute/$ft^2$.

Embodiment 19

The method according to any of embodiments 14-18, wherein the nonwoven fabric has a mean pore size of no more than 41 microns.

Embodiment 20

The method according to any of embodiments 14-19, wherein the nonwoven fabric has a thickness of at least 18 mils and a fabric density of at least 0.18 g/cc.

Embodiment 21

The method according to any of embodiments 14-20, wherein the nonwoven fabric is adapted to separate at least 95% of 320 cp oil from an oil and water emulsion that contains about 4.5% of 320 cp oil as measured according to test method 1664A HEM (Oil and Grease).

Embodiment 22

The silt retention system or method according to any of embodiments 1-21, wherein the fabric is adapted to absorb at least twice its weight in oil.

Embodiment 23

The silt retention system or method according to any of embodiments 1-22, wherein the nonwoven fabric comprises a UV stabilizer, and wherein the UV stabilizer is about 1.5% of the fabric.

Embodiment 24

The method according to any of embodiments 16-23, wherein the UV stabilizer is added to the master batch in an amount of about 0.14% of the master batch.

Following are examples that illustrate procedures for practicing the invention. These examples should not be construed as limiting.

EXAMPLE 1

PBN-II® fabric with a basis weight of 0.85 osy was exposed to a xenon light source for 1000 hours. This fabric is a thermally bonded nylon spunbonded fabric with the pattern illustrated in registered United States Trademark 2,163,116. At no exposure to xenon light, the machine direction grab tensile strength of the fabric was measured at 22.45 pounds force ($lb_f$) using ASTM D5034. After 400 hours exposure to xenon light, the machine direction grab tensile strength of the fabric was measured at 21.8 $lb_f$ using ASTM D5034. After 1000 hours exposure to xenon light, the machine direction grab tensile strength of the fabric was measured at 19.6 $lb_f$ using ASTM D5034. This fabric retained 87% of its machine direction grab tensile strength as measured by ASTM D5034.

EXAMPLE 2

PBN-II® fabric with a basis weight of 0.85 osy made with the addition of a proprietary UV blocker and stabilizer additive master batch was exposed to a xenon light source for 1000 hours. This fabric is a thermally bonded nylon spunbonded fabric with the pattern illustrated in registered United States Trademark 2,163,116. At no exposure to xenon light, the machine direction grab tensile strength of the fabric was measured at 21.9 $lb_f$ using ASTM D5034. After 400 hours exposure to xenon light, the machine direction grab tensile strength of the fabric was measured at 20.8 $lb_f$ using ASTM D5034. After 1000 hours exposure to xenon light, the machine direction grab tensile strength of the fabric was measured at 21.1 $lb_f$ using ASTM D5034. This fabric retained 96% of its machine direction grab tensile strength as measured by ASTM D5034.

EXAMPLE 3

Studies were conducted with two oils to determine absorption for different kinds of fabrics. A highly viscous gear lube oil, Spartan EP 320 by Mobil and a number 4 crude oil that is not as dense were tested. Three inch square pieces of fabric were weighed prior to and after soaking them in oil.

The results using several nylon spunbonded fabrics available from Cerex Advanced Fabrics, Inc. are tabulated below along with the results of a polyester spunbonded fabric. Table 1 shows the calculated ounces of oils that would be absorbed by one square yard of the studied fabrics based on the 3 inch by 3 inch sample results.

TABLE 1

Oil absorbed by fabrics

| Fabric | Basis Weight (osy) | Calculated ounces of EP320 oil absorbed by one ounce of fabric | Calculated ounces of Number 4 crude oil absorbed by one ounce of fabric |
|---|---|---|---|
| PBN-II ® | 1 | 10.86 | n/a |
| PBN-II ® | 2 | 13.92 | 5.42 |
| PBN-II ® | 3 | 12.00 | 5.76 |
| PBN-II ® | 4 | 18.28 | 5.88 |
| SPECTRAMAX ® | 1 | 10.86 | n/a |
| SPECTRAMAX ® | 3 | n/a | 5.46 |
| SPECTRAMAX ® | 4 | 10.52 | 5.12 |
| Polyester Spunbond | 1 | 4.50 | 1.25 |

n/a - this test was not performed

In an embodiment, a 3 inch by 3 inch sample of 3 osy PBN-II® fabric weighing about 0.6 grams absorbed 2.4 grams of EP 320 oil. This is 4 times its weight. In another embodiment, a 3 inch by 3 inch sample of four osy PBN-II® fabric weighing about 0.7 grams absorbed 3.2 grams of EP 320 oil. This is 4.57 times its weight. In certain embodiments, the fabric used absorbs a weight of Spartan EP 320 oil that is at least equal, and preferably twice, five times, ten times or more, the weight of the fabric.

EXAMPLE 4

PBN-II® fabric with a basis weight of 4.0 osy was tested for flux rate and filter efficiency using ASTM D5141 by Civil & Environmental Consultants, Inc. This fabric is commercially available as Type 30 from Cerex Advanced Fabrics, Inc. and sold under the trademarks PBN-II® and OIL SHARK®. The fabric was a thermally bonded nylon spunbonded fabric with the pattern illustrated in registered United States Trademark 2,163,116. The ASTM D5141 testing that was performed consisted of small scale flume runs in a 2.8 foot wide by 4 foot long flume sloped at 8%. A fifty liter aqueous mixture of soil was prepared at a concentration of 3,000 milligrams per liter of suspended solids and passed into the flume at a rate of no less than five liters per second. Both solid retention and flow rates through the fabric were derived from this test. The results of three replicates are shown in Table 2.

Typical physical properties of this fabric are listed in Table 3 below. The density of this fabric is calculated to be 0.234 grams per cubic centimeter which is higher than the density of the BSRF fabric—0.15 grams per cubic centimeter and a mean pore size of about 47 microns. The flux results are at least 25 times better than the flux results of the BSRF fabric and the filter efficiency is higher. This is a surprising result considering the density of the 4 ounce per square yard PBN-II® fabric is higher than that of the BSRF fabric, there are about 20% (of the area) bond points that do not allow flow in the PBN-H® fabric, and the mean pore size of PBN-II® fabric is lower than that of the BSRF fabric. It would have been expected that the lower density fabric with the higher mean pore size and no bond points would show better filter efficiency and flux rates.

TABLE 2

ASTM D5141 Results for 4 osy PBN-II ® fabric

| Replicate | Flux (gpm/ft$^2$) | Filter Efficiency (%) |
|---|---|---|
| 1 | 0.94 | 99.5 |
| 2 | 0.91 | 99.1 |
| 3 | 1.20 | 99.3 |

TABLE 3

Typical Physical properties of 4 ounce per square yard Type 30

| Physical Property | ASTM | Units | Target |
|---|---|---|---|
| Basis Weight | D3776 | Ounces/yd$^2$ | 4 |
| Thickness | D1777 | Mils | 22.3 |
| Textest Air Permeability | D737 | ft$^3$/minute/ft$^2$ | 125 |
| Machine Direction Grab Strength | D5034 | lb$_f$ | 156.9 |
| Machine Direction Grab Elongation | D5034 | % | 91 |
| Cross Direction Grab Strength | D5034 | lb$_f$ | 118.8 |
| Cross Direction Grab Elongation | D5034 | % | 100 |
| Machine Direction Trapezoidal Strength | D5587 | lb$_f$ | 49 |
| Cross Direction Trapezoidal Strength | D5587 | lb$_f$ | 34.2 |
| Burst Strength | D3786 | lb/in$^2$ | 109.4 |
| Machine Direction Grab Strength | D4632 | lb$_f$ | 174.2 |
| Machine Direction Grab Elongation | D4632 | % | 115.1 |
| Cross Direction Grab Strength | D4632 | lb$_f$ | 126.2 |
| Cross Direction Grab Elongation | D4632 | % | 112.6 |
| Mean pore size | | Microns | 31 |
| Machine Direction Grab Strength retention after exposed to xenon light for 1000 hours | D5034 | % | 87 |
| Density | Calculated | g/cm$^3$ | 0.234 |

EXAMPLE 5

An orange nylon fabric, QG400, similar to example 4 was made by adding a combination of an orange solvent dye and a red solvent dye to the extruder spinning nylon 6,6 resin. This fabric is a thermally bonded nylon spunbonded fabric with the pattern illustrated in registered United States Trademark 2,163,116. These solvent dyes do not contain lead or hexavalent chromium. This fabric will pass the criteria for NSF/ANSI Standard 61, which is the nationally (in the United States) recognized health standard for all devices, components, and materials that contact drinking water. This fabric will also pass the criteria for SW-846, which is the EPA standard for allowing wastes to be treated as non-hazardous waste.

Physical properties of the fabric were measured and are listed in Table 4 below. This fabric was exposed to a xenon light source and water spray as described in ASTM D4355. Grab tensile properties were measured initially and at 150, 300, and 500 hours of exposure time. The results are shown in Table 5. The process used to make this fabric is similar to the process used to make the 4 ounce per square yard fabric as described in example 4. The flux and filter efficiency performance of this fabric is similar to the fabric listed in Table 4. Mean pore size and tensile strength retention after exposure to a xenon light source for 100 hours using ASTM D5034 is similar to the fabric of Example 4. This fabric originally has an orange color close to Pantone® 159C. The fabric retained its orange color and became a lighter orange color close to Pantone® 472C after 500 hours of exposure to a xenon light source and water spray as described in ASTM D4355-07. The orange color retention is a surprising result since many dyes do not exhibit good colorfastness. It would have been expected that the color of the fabric would be much lighter after such a long exposure to a xenon light source and water spray as described in ASTM D4355-07.

TABLE 4

Typical Physical properties of 4 ounce per square yard orange fabric QG400

| Physical Property | ASTM | Units | Average |
|---|---|---|---|
| Basis Weight | D3776 | Ounces/yd$^2$ | 4.07 |
| Thickness | D1777 | Mils | 22.9 |
| Textest Air Permeability | D737 | ft$^3$/minute/ft$^2$ | 98 |
| Machine Direction Grab Strength | D5034 | lb$_f$ | 149.6 |
| Machine Direction Grab Elongation | D5034 | % | 90.1 |
| Cross Direction Grab Strength | D5034 | lb$_f$ | 119.3 |
| Cross Direction Grab Elongation | D5034 | % | 98.6 |
| Machine Direction Trapezoidal Strength | D5587 | lb$_f$ | 40.8 |
| Cross Direction Trapezoidal Strength | D5587 | lb$_f$ | 26.1 |
| Burst Strength | D3786 | Lb/in$^2$ | 116.6 |
| Density | calculated | g/cm$^3$ | 0.231 |

TABLE 5

Tensile properties of orange fabric QG400 after xenon light and water spray exposure as per ASTM D4355

| Physical Property | Units | No exposure | 150 Hours exposure | 300 Hours exposure | 500 Hours exposure |
|---|---|---|---|---|---|
| Machine Direction Grab Strength | lb$_f$ | 141.6 | 112.3 | 63.8 | 45.7 |
| Machine Direction Grab Elongation | % | 121.9 | 97.6 | 33.9 | 24.3 |
| Cross Direction Grab Strength | lb$_f$ | 98.6 | 76.2 | 42.8 | 28.8 |
| Cross Direction Grab Elongation | % | 133.8 | 99.8 | 43.1 | 29.6 |

EXAMPLE 6

Orange nylon fabrics, QJ400 and QK400 similar to examples 4 and 5 were made by adding a combination of an orange solvent dye and a red solvent dye to the extruder spinning nylon 6,6 resin along with two levels of a proprietary UV blocker and stabilizer additive master batch. The amount of UV stabilizer added to the master batch was about 0.75% for the QJ400 fabric and about 1.5% for the QK400 fabric. The level of active proprietary UV stabilizer ingredient was measured to be about 0.14% in the QK400 fabric. This fabric is a thermally bonded nylon spunbonded fabric with the pattern illustrated in registered United States Trademark 2,163, 116. These solvent dyes do not contain lead or hexavalent chromium. This fabric will pass the criteria for NSF/ANSI Standard 61, which is the nationally (in the United States) recognized health standard for all devices, components, and materials that contact drinking water. This fabric will also pass the criteria for SW-846, which is the EPA standard for allowing wastes to be treated as non-hazardous waste. Physical properties of the fabrics were measured and are listed in Table 6 below. In Table 6, MD stands for machine direction and CD stands for cross direction.

The initial machine direction tensile strength of the two orange fabrics, QJ400 and QK400 is at least twice as high as the BSRF fabric. The cross directional tensile strength is about 20 to 60% higher than the BSRF fabric. The two fabrics, QJ400 and QK400 were tested for weathering as described in ASTM D4355. Table 6 also shows the results of these tests. Adding the UV stabilizer improved the tensile strength and maintained the elongation of the orange fabrics. The master batch add-in rate of the UV stabilizer was estimated and is listed in Table 6. The machine direction tensile strength is higher than the BSRF fabric after 500 hours of exposure to a xenon light source and water spray as measured and described in ASTM D4355-07. The averages of the cross directional strength of the orange fabrics were slightly lower than the BSRF fabric but not statistically different when compared using a statistical t test for the difference between two averages. These orange fabrics with no reinforcements can be used instead of the related art BSRF fabric to make a stronger silt fence.

Figure 5:
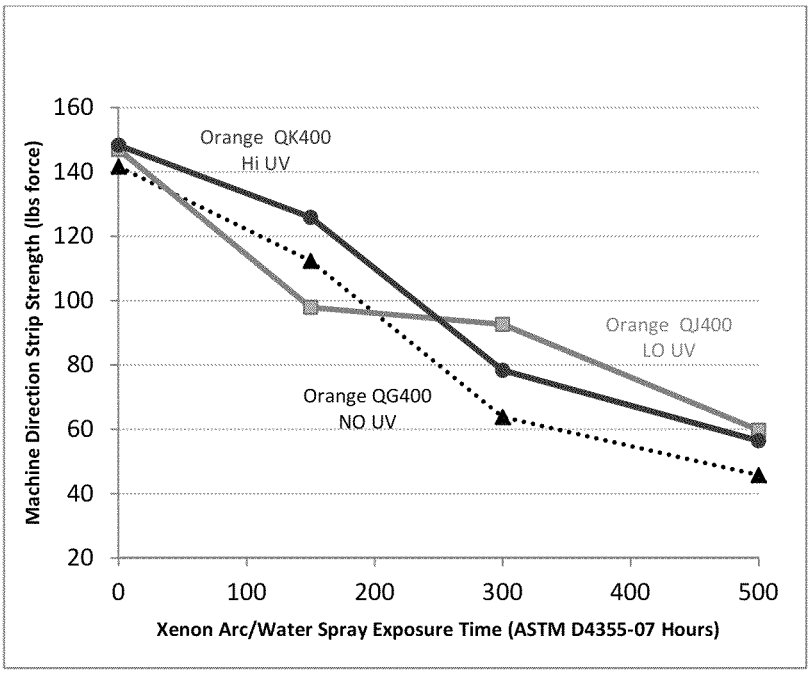
FIG. 5 is a plot of machine direction grab strength as a function of exposure time.
Figure 6:
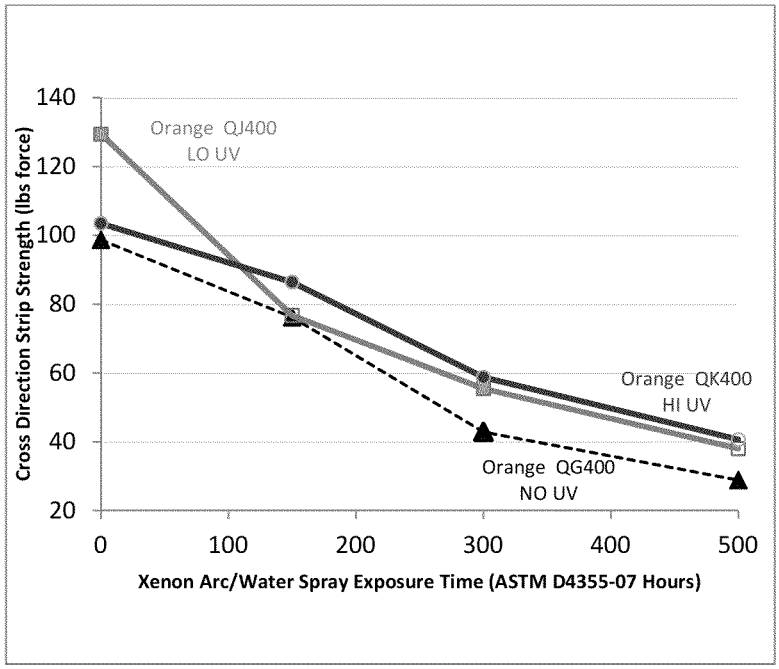
FIG. 6 is a plot of cross direction grab strength as a function of exposure time.
Figure 7:
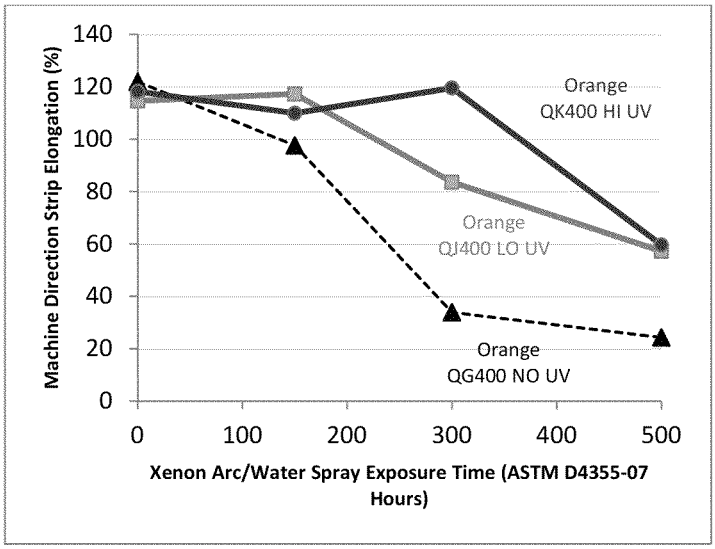
FIG. 7 is a plot of machine direction grab elongation as a function of exposure time.
Figure 8:
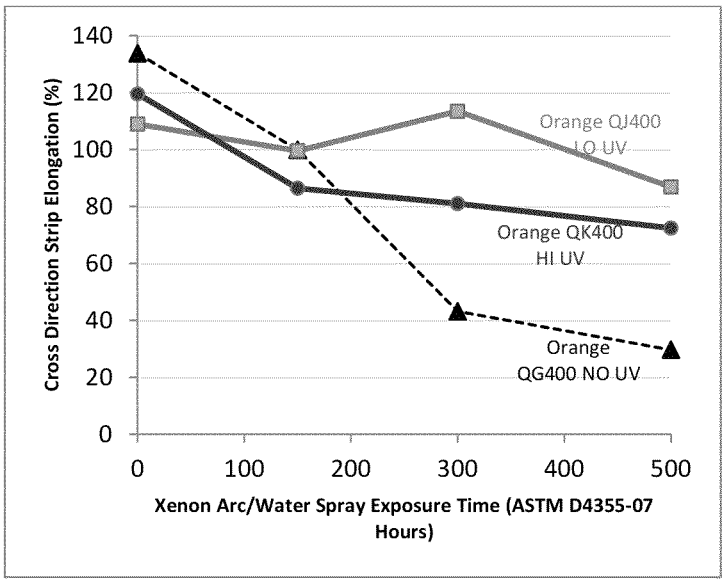
FIG. 8 is a plot of cross direction grab elongation as a function of exposure time.

FIG. 5 is a graph of machine direction grab strength ($lb_f$) as a function of exposure time (hrs) to xenon light and water spray exposure as per ASTM D4355 for the fabric of Example 5 and those of Example 6. FIG. 6 is a graph of cross direction grab strength ($lb_f$) as a function of exposure time (hrs) to xenon light and water spray exposure as per ASTM D4355 for the fabric of Example 5 and those of Example 6. FIG. 7 is a graph of machine direction grab elongation (%) as a function of exposure time (hrs) to xenon light and water spray as per ASTM D4355 for the fabric of Example 5 and those of Example 6. FIG. 8 is a graph of cross direction grab elongation (%) as a function of exposure time (hrs) to xenon light and water spray as per ASTM D4355 for the fabric of Example 5 and those of Example 6.

Figure 9:
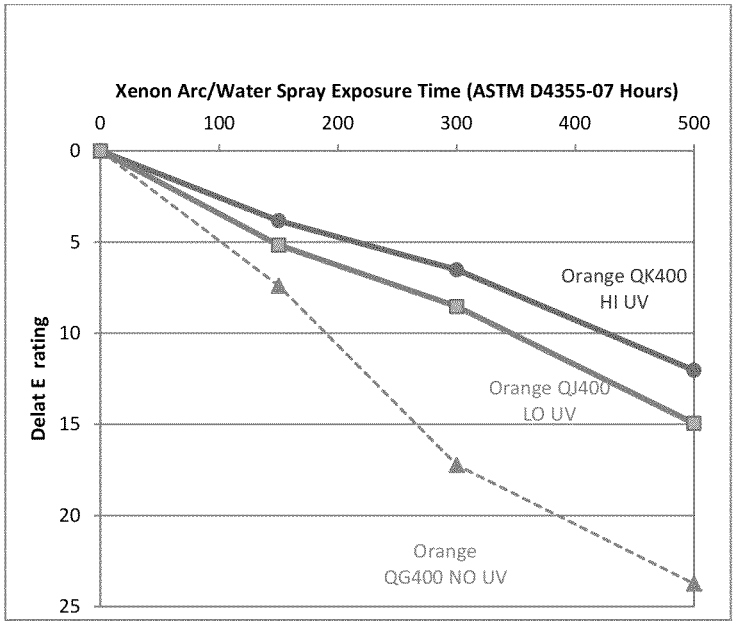
FIG. 9 is a plot of color change as a function of exposure time.
Figure 10:
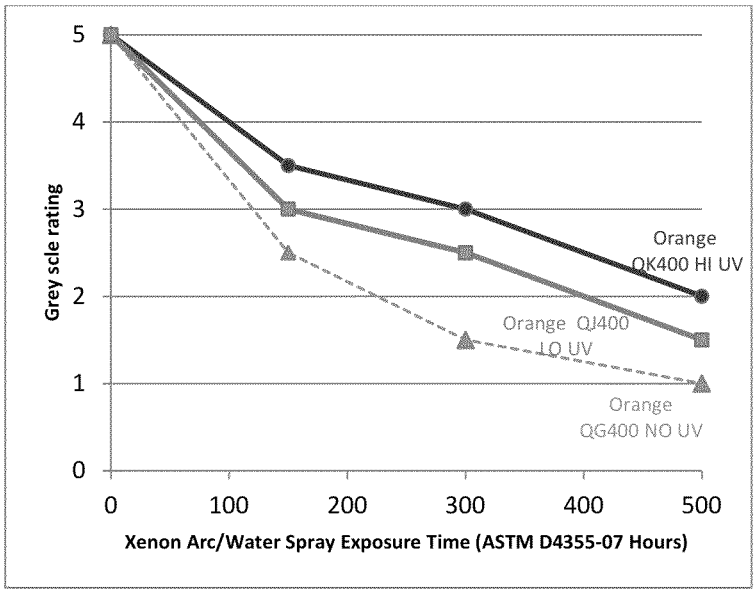
FIG. 10 is a plot of color change as a function of exposure time.

FIG. 9 is a graph of color change (delta E rating) as a function of exposure time (hrs) to xenon light and water spray as per ASTM D4355 for the fabric of Example 5 and those of Example 6. FIG. 10 is a graph of color change (grey scale rating) as a function of exposure time (hrs) to xenon light and water spray as per ASTM D4355 for the fabric of Example 5 and those of Example 6. In each of FIGS. 5-10, the line with the triangle data points is for the fabric of Example 5, the line with the square data points is for the QJ400 fabric of Example 6, and the line with the circle data points is for the QK400 fabric of Example 6. The advantages of the UV blocker (or stabilizer) with respect to strength and elongation after light and water exposure are evident from FIGS. 5-10.

Figure 11:
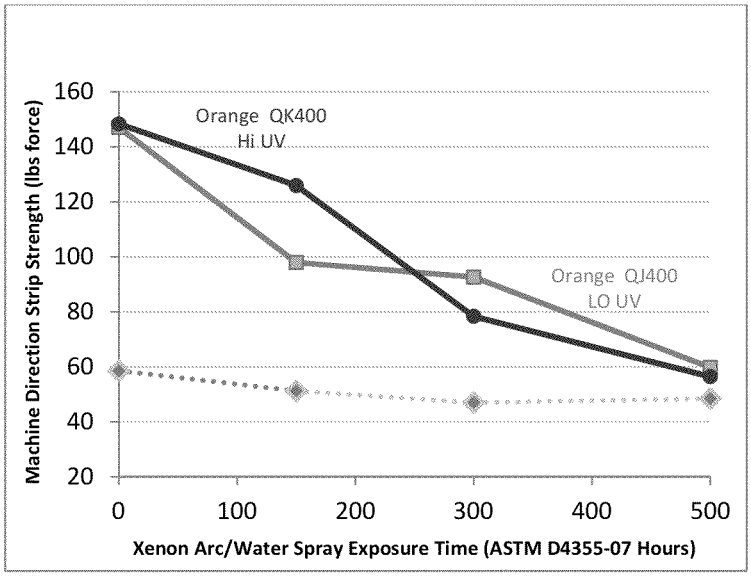
FIG. 11 is a plot of machine direction grab strength as a function of exposure time.
Figure 12:
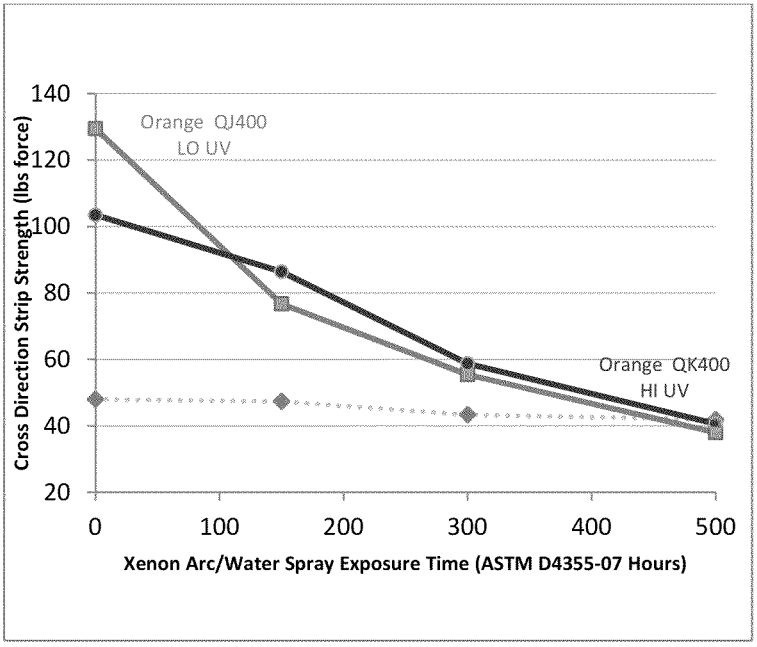
FIG. 12 is a plot of cross direction grab strength as a function of exposure time.
Figure 13:
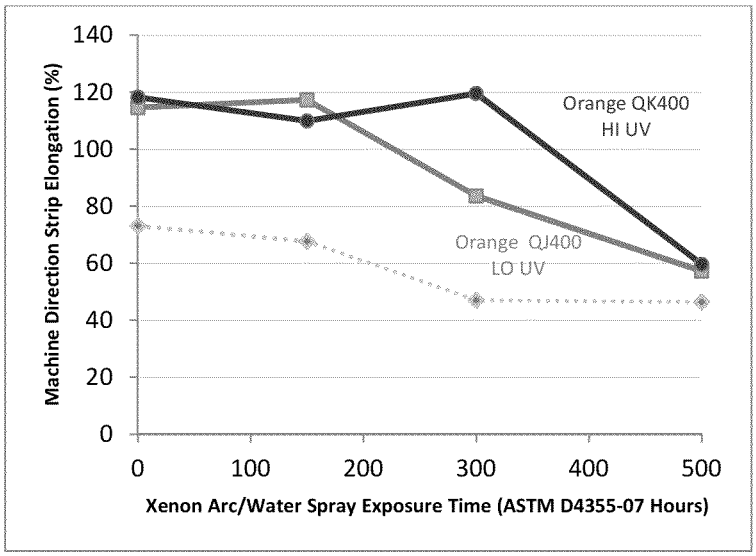
FIG. 13 is a plot of machine direction grab elongation as a function of exposure time.
Figure 14:
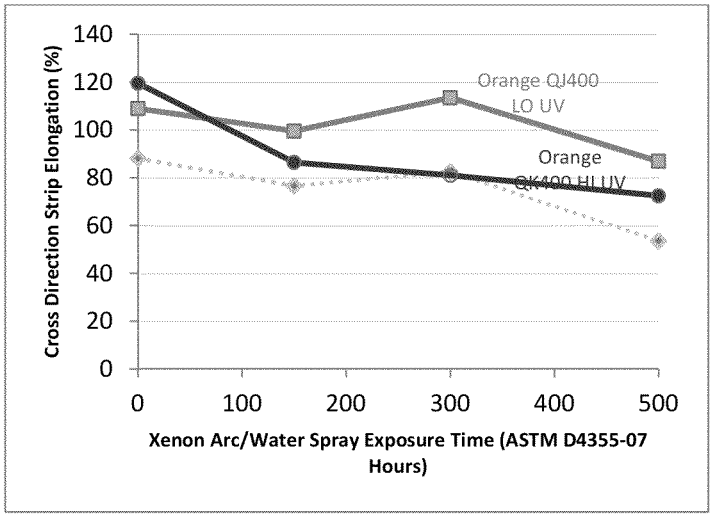
FIG. 14 is a plot of cross direction grab elongation as a function of exposure time.

FIG. 11 is a graph of machine direction grab strength ($lb_f$) as a function of exposure time (hrs) to xenon light and water spray exposure as per ASTM D4355 for the related art BSRF fabric and the fabrics of Example 6 according to embodiments of the subject invention. FIG. 12 is a graph of cross direction grab strength ($lb_f$) as a function of exposure time (hrs) to xenon light and water spray exposure as per ASTM D4355 for the related art BSRF fabric and the fabrics of Example 6 according to embodiments of the subject invention. FIG. 13 is a graph of machine direction grab elongation (%) as a function of exposure time (hrs) to xenon light and water spray as per ASTM D4355 for the related art BSRF fabric and the fabrics of Example 6 according to embodiments of the subject invention. FIG. 14 is a graph of cross direction grab elongation (%) as a function of exposure time (hrs) to xenon light and water spray as per ASTM D4355 for the related art BSRF fabric and the fabrics of Example 6 according to embodiments of the subject invention.

In each of FIGS. 11-14, the line with the triangle data points is for the related art BSRF fabric, the line with the square data points is for the QJ400 fabric of Example 6 according to an embodiment of the subject invention, and the line with the circle data points is for the QK400 fabric of Example 6 according to an embodiment of the subject invention. The advantages of the fabrics of the subject invention over the related art fabric, particularly with respect to strength and elongation after light and water exposure, can be seen in FIGS. 11-14.

TABLE 6

Typical Physical properties of 4 ounce per square yard orange fabrics QJ400 and QK400

| Physical Property | ASTM | Units | Average QJ400 | Average QK400 |
|---|---|---|---|---|
| Basis Weight | D3776 | Ounces/yd$^2$ | 3.96 | 3.97 |
| Thickness | D1777 | Mils | 22.5 | 21.7 |
| Textest Air Permeability | D737 | ft$^3$/minute/ft$^2$ | 107.1 | 101.1 |
| Machine Direction Grab Strength | D5034 | $lb_f$ | 161.8 | 150.3 |
| Machine Direction Grab Elongation | D5034 | % | 97 | 92.9 |
| Cross Direction Grab Strength | D5034 | $lb_f$ | 120.4 | 118.4 |
| Cross Direction Grab Elongation | D5034 | % | 95.8 | 98.5 |
| Machine Direction Trapezoidal Strength | D5587 | $lb_f$ | 35.5 | 37.9 |
| Cross Direction Trapezoidal Strength | D5587 | $lb_f$ | 26.5 | 25.5 |
| Burst Strength | D3786 | Lb/in$^2$ | 98.9 | 100.1 |
| Density | Calculated | g/cm$^3$ | 0.229 | 0.238 |
| Mean pore size | | microns | N/A | 47.6 |
| MD Geo Strip Tensile Strength | D4355 (D5035) | $lb_f$ | 147 | 148 |
| CD Geo Strip Tensile Strength | D4355 (D5035) | $lb_f$ | 129 | 103 |
| MD Geo Strip Tensile Elongation | D4355 (D5035) | % | 115 | 118 |

TABLE 6-continued

Typical Physical properties of 4 ounce per square yard orange fabrics QJ400 and QK400

| Physical Property | ASTM | Units | Average QJ400 | Average QK400 |
|---|---|---|---|---|
| CD Geo Strip Tensile Elongation | D4355 (D5035) | % | 109 | 120 |
| 500 hr MD Geo Strip Tensile Strength | D4355 (D5035) | $lb_f$ | 60 | 56 |
| 500 hr CD Geo Strip Tensile Strength | D4355 (D5035) | $lb_f$ | 38 | 41 |
| 500 hr MD Geo Strip Tensile Elongation | D4355 (D5035) | % | 57 | 60 |
| 500 hr CD Geo Strip Tensile Elongation | D4355 (D5035) | % | 87 | 72 |
| UV resistance MD 500 hrs | D4355 | % | 41 | 38 |
| UV resistance CD 500 hrs | D4355 | % | 29 | 39 |
| 300 hr MD Geo Strip Tensile Strength | D4355 (D5035) | $lb_f$ | 93 | 78 |
| 300 hr CD Geo Strip Tensile Strength | D4355 (D5035) | $lb_f$ | 55 | 59 |
| 300 hr MD Geo Strip Tensile Elongation | D4355 (D5035) | % | 84 | 120 |
| 300 hr CD Geo Strip Tensile Elongation | D4355 (D5035) | % | 113 | 81 |
| UV resistance MD 300 hrs | D4355 | % | 63 | 52 |
| UV resistance CD 300 hrs | D4355 | % | 43 | 57 |
| 150 hr MD Geo Strip Tensile Strength | D4355 (D5035) | $lb_f$ | 98 | 126 |
| 150 hr CD Geo Strip Tensile Strength | D4355 (D5035) | $lb_f$ | 77 | 86 |
| 150 hr MD Geo Strip Tensile Elongation | D4355 (D5035) | % | 117 | 110 |
| 150 hr CD Geo Strip Tensile Elongation | D4355 (D5035) | % | 87 | 72 |
| UV resistance MD 150 hrs | D4355 | % | 67 | 85 |
| UV resistance CD 150 hrs | D4355 | % | 60 | 83 |
| Amount of UV Master batch added | (Estimated) | % | 0.75 | 1.5 |

EXAMPLE 7

A 3 osy orange nylon fabric can be made, similar to that in Example 5 by adding a combination of an orange solvent dye and a red solvent dye to an extruder melt spinning nylon 6,6 resins. This fabric would be a thermally bonded nylon spun-bonded fabric with the pattern illustrated in registered United States Trademark 2,163,116. The bond points make up between 17% to 25% of the fabric area. These bond points are not porous and are actually tiny areas of film in the fabric making the fabric less open. The fabric would contain no reinforcement material. The solvent dyes do not contain lead or hexavalent chromium, so the fabric did not contain any of these materials. The same UV additives described in previous Examples at similar levels can be incorporated in the fabric. The fabric was manufactured using materials such that the fabric would pass the criteria for NSF/ANSI Standard 61, which is the nationally (in the United States) recognized health standard for all devices, components, and materials that contact drinking water. The fabric can be manufactured using materials such that the fabric would pass the criteria for SW-846, the EPA criteria for allowing wastes to be treated as non-hazardous waste.

Physical properties of the fabric are listed in Table 7 below. The process that would be used to make this fabric is similar to the process used to make the 4 osy fabric as described in Example 5, except that the basis weight can be 3 osy. The fabric would have an easily seen orange color close to Pantone® 159C. It would be expected that the same percentage retention of tensile properties would be observed on this fabric after 150, 300, and 500 hours of weathering as per ASTM D-4355-07 as the orange fabric in the previous Examples. The weathering results of the orange fabric with the higher level of UV additive, QK400, were used to estimate the value of tensile properties after 300 and 500 hours of exposure as per ASTM D-4355-07 and are listed in Table 7. In Table 7, MD stands for machine direction and CD stands for cross direction.

TABLE 7

Physical properties of 3 ounce per square yard orange fabric

| Physical Property | ASTM | Units | Specification or Average Value | Minimum roll Average | Maximum roll Average |
|---|---|---|---|---|---|
| Basis Weight | D3776 | ounces/$yd^2$ | 3 | 2.69 | 3.31 |
| Thickness | D1777 | mils | 19.1 | 16.5 | 21.8 |
| Textest Air Permeability | D737 | $ft^3$/minute/$ft^2$ | 197 | 150 | 243 |

TABLE 7-continued

| Physical properties of 3 ounce per square yard orange fabric | | | | | |
|---|---|---|---|---|---|
| Physical Property | ASTM | Units | Specification or Average Value | Minimum roll Average | Maximum roll Average |
| Machine Direction Grab Strength | D5034 | $lb_f$ | 115.6 | 93.2 | 138.1 |
| Machine Direction Grab Elongation | D5034 | % | 84 | 67 | 102 |
| Cross Direction Grab Strength | D5034 | $lb_f$ | 86.0 | 64.9 | 107 |
| Cross Direction Grab Elongation | D5034 | % | 94 | 78 | 110 |
| Machine Direction Grab Strength | D4632 | $lb_f$ | 130 | N/A | N/A |
| Machine Direction Grab Elongation | D4632 | % | 106 | N/A | N/A |
| Cross Direction Grab Strength | D4632 | $lb_f$ | 99 | N/A | N/A |
| Cross Direction Grab Elongation | D4632 | % | 105 | N/A | N/A |
| Machine Direction Trapezoidal Strength | D5587 | $lb_f$ | 35.8 | 24.2 | 47.3 |
| Cross Direction Trapezoidal Strength | D5587 | $lb_f$ | 24.4 | 15.6 | 33.2 |
| Mean pore size | | microns | 34.1 | N/A | N/A |
| Mullen Burst Strength | D3786 | $lb/in^2$ | 79.3 | 54.3 | 104.3 |
| Density | calculated | $g/cm^3$ | 0.210 | 0.19 | 0.27 |
| Estimated MD Grab Strength After 300 hour exposure | D5034 | $lb_f$ | 61 | 49.2 | 72.9 |
| Estimated CD Grab Strength After 300 hour exposure | D5034 | $lb_f$ | 48 | 36.8 | 60.7 |
| Estimated MD Grab Elongation After 300 hour exposure | D5034 | % | 85 | 68 | 103 |
| Estimated CD Grab Elongation After 300 hour exposure | D5034 | % | 63 | 52 | 69 |
| Estimated MD Grab Strength After 500 hour exposure | D5034 | $lb_f$ | 44 | 35 | 52 |
| Estimated CD Grab Strength After 500 hour exposure | D5034 | $lb_f$ | 33 | 25 | 42 |
| Estimated MD Grab Elongation After 500 hour exposure | D5034 | % | 42 | 38 | 55 |
| Estimated CD Grab Elongation After 500 hour exposure | D5034 | % | 56 | 47 | 66 |

Any estimated values were calculated from process capability data and results of ASTM D5534 07 testing of QK400 described in previous Examples.

EXAMPLE 8

A 4 osy orange nylon fabric can be made, that is similar to the fabric of Example 5, by adding a combination of an orange solvent dye and a red solvent dye to an extruder spinning nylon 6,6 resins. The fabric would be a thermally bonded nylon spunbonded fabric with a diamond pattern and could be obtained from Cerex Advanced Fabrics, Inc. in Cantonment, Fla. under the trade name "Orion". The bond points make up between 17% to 25% of the fabric area. These bond points are not porous and are actually tiny areas of film in the fabric making the fabric less open. This fabric would contain no reinforcement material. The solvent dyes do not contain lead or hexavalent chromium so the fabric would not contain any of these materials. The same UV additives described in previous Examples at similar levels can be incorporated in the fabric. The fabric can be manufactured using materials such that the fabric would pass the criteria for NSF/ANSI Standard 61, which is the nationally (in the United States) recognized health standard for all devices, components, and materials that contact drinking water. The fabric can be manufactured using materials such that the fabric would pass the criteria for SW-846, the EPA criteria for allowing wastes to be treated as non-hazardous waste.

Physical properties of the fabric are listed in Table 8 below. The process used to make this fabric is similar to the process used to make the 4 osy fabric described in Example 5, except that the fabric would be made with a different bond pattern. The fabric would be made to have an easily seen orange color close to Pantone® 159C. It would be expected that the same percentage retention of tensile properties would be observed on this fabric after 150, 300, and 500 hours of weathering as per ASTM D-4355 07 as the fabrics described in the previous Examples.

TABLE 8

Physical properties of 4 ounce per square yard ORION ® orange fabric

| Physical Property | ASTM | Units | Average |
|---|---|---|---|
| Basis Weight | D3776 | ounces/yd | 4 |
| Thickness | D1777 | mils | 19.3 |
| Textest Air Permeability | D737 | $ft^3/minute/ft^2$ | 91 |
| Machine Direction Grab Strength | D5034 | $lb_f$ | 155.2 |
| Machine Direction Grab Elongation | D5034 | % | 87 |
| Cross Direction Grab Strength | D5034 | $lb_f$ | 115.8 |
| Cross Direction Grab Elongation | D5034 | % | 91 |
| Machine Direction Trapezoidal Strength | D5587 | $lb_f$ | 40.2 |
| Cross Direction Trapezoidal Strength | D5587 | $lb_f$ | 29 |
| Mullen Burst Strength | D3786 | $lb/in^2$ | 108.4 |
| Density | calculated | $g/cm^3$ | 0.277 |

EXAMPLE 9

Samples of oil and seawater were made using seawater from the Gulf of Mexico and about 4.5% Mobil® Spartan® EP320 Gear Lube oil. Sewn bags were made from 2-, 3-, and 4-ounce per square yard (osy) PBN-II® nylon spunbond fabrics. These fabrics are commercially available from Cerex Advanced Fabrics, Inc. in Cantonment, Fla. The bags were inserted into a 1.5-inch PVC pipe and set in a horizontal position simulating the method of deployment of the OIL SHARK® BAG used in pontoon boats. Trials were run where 500 mL of the oil and seawater mixture was sent through the bag within the pipe. One set of experiments sent approximately 500 mL of mixture through the bag. Test method 1664A HEM (n-Hexane Extractable Material) (Oil and Grease) was performed by Test America Lab in Pensacola, Florida on the oil and seawater mixtures before and after passing through the bag. Table 9 below shows the results of the trials. Testing results show that all the bags removed at least 97.4% of the oil from the seawater. This demonstrates the excellent performance for separating oil from seawater of OIL SHARK® BAGS made using PBN-II® fabrics in the 2 to 4 osy basis weight range.

TABLE 9

Results of Oil Separation Tests Using PBN-II ® fabrics

| Fabric | Basis Weight (osy) | Ppm oil and grease of original water and oil sample | Ppm Oil and Grease after separation using OIL SHARK ® BAG | % Oil Separated |
|---|---|---|---|---|
| PBN-II ® | 2 | 43,000 | 510 | 98.8% |
| PBN-II ® | 3 | 47,000 | 370 | 99.2% |
| PBN-II ® | 4 | 43,000 | 1100 | 97.4% |

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A silt retention system, comprising a nonwoven fabric having no reinforcement, wherein the nonwoven fabric has an average filter efficiency of at least 93% as measured by ASTM (American Society for Testing and Materials) D5141, and a tensile strength of at least about 85 pounds force ($lb_f$) as measured by ASTM D4632, and wherein the nonwoven fabric passes the criteria for United States Environmental Protection Agency (EPA) SW-846, Third Edition.

2. The silt retention system according to claim 1, wherein the nonwoven fabric comprises an engraved pattern.

3. The silt retention system according to claim 1, wherein the nonwoven fabric is a bonded nonwoven fabric and_comprises a bond area of 17% to 25% of the nonwoven fabric.

4. The silt retention system according to claim 1, wherein the nonwoven fabric has a filter efficiency of at least 93% for a flux rate of at least 0.9 gallons per minute per square foot as measured by ASTM D5141.

5. The silt retention system according to claim 1, wherein the nonwoven fabric has a basis weight in a range of from 1 ounce per square yard (osy) to 12 osy.

6. The silt retention system according to claim 1, wherein the nonwoven fabric has an air permeability of no more than 250 cubic feet per minute per square foot ($ft^3/minute/ft^2$).

7. The silt retention system according to claim 1, wherein the nonwoven fabric has a mean pore size of no more than 41 microns.

8. The silt retention system according to claim 1, wherein the nonwoven fabric has a thickness of at least 18 mils and a fabric density of at least 0.18 grams per cubic centimeter (g/cc).

9. The silt retention system according to claim 1, wherein the nonwoven fabric comprises a UV stabilizer, and wherein the nonwoven fabric is adapted to have, after 500 hours of exposure to a xenon light source and water spray according to the protocol described in ASTM D5534 07, a machine direction grab tensile strength of at least 44 $lb_f$ as measured by ASTM D5034, a cross direction grab tensile strength of at least 33 $lb_f$ as measured by ASTM D5034, a machine direction elongation of at least 42% as measured by ASTM D5034, and a cross direction elongation of at least 56% as measured by ASTM D5034.

10. The silt retention system according to claim 9, wherein the nonwoven fabric has an orange shade that is at least as dark as a Pantone 472C after 500 hours of exposure to a xenon light source and water spray according to the protocol described in ASTM D4355 07.

11. The silt retention system according to claim 1, wherein the nonwoven fabric is adapted to separate at least 95% of 320 centipoise (cp) oil from an oil and water emulsion that contains about 4.5% of 320 cp oil as measured according to test method 1664A HEM (n-Hexane Extractable Material) (Oil and Grease).

12. A silt retention system, comprising a nonwoven fabric having no reinforcement, wherein the nonwoven fabric has an average filter efficiency of at least 93% as measured by ASTM (American Society for Testing and Materials) D5141, and a tensile strength of at least about 85 pounds force ($lb_f$) as measured by ASTM D4632, and wherein the nonwoven fabric passes the criteria for NSF/ANSI Standard 61-2007a.

13. The silt retention system according to claim 12, wherein the nonwoven fabric is a bonded nonwoven fabric andsomprises a bond area of 17% to 25% of the nonwoven fabric.

14. The silt retention system according to claim 12, wherein the nonwoven fabric has a basis weight in a range of from 1 ounce per square yard (osy) to 12 osy.

15. The silt retention system according to claim 12, wherein the nonwoven fabric has an air permeability of no more than 250 cubic feet per minute per square foot ($ft^3/minute/ft^2$).

16. The silt retention system according to claim 12, wherein the nonwoven fabric has a mean pore size of no more than 41 microns.

17. The silt retention system according to claim 12, wherein the nonwoven fabric has a thickness of at least 18 mils and a fabric density of at least 0.18 grams per cubic centimeter (g/cc).

18. The silt retention system according to claim 12, wherein the nonwoven fabric comprises a UV stabilizer, and wherein the nonwoven fabric is adapted to have, after 500 hours of exposure to a xenon light source and water spray according to the protocol described in ASTM D5534 07, a machine direction grab tensile strength of at least 44 $lb_f$ as measured by ASTM D5034, a cross direction grab tensile strength of at least 33 $lb_f$ as measured by ASTM D5034, a machine direction elongation of at least 42% as measured by ASTM D5034, and a cross direction elongation of at least 56% as measured by ASTM D5034.

19. The silt retention system according to claim 18, wherein the nonwoven fabric has an orange shade that is at least as dark as a Pantone 472C after 500 hours of exposure to a xenon light source and water spray according to the protocol described in ASTM D4355 07.

20. The silt retention system according to claim 12, wherein the nonwoven fabric is adapted to separate at least 95% of 320 centipoise (cp) oil from an oil and water emulsion that contains about 4.5% of 320 cp oil as measured according to test method 1664A HEM (n-Hexane Extractable Material) (Oil and Grease).

* * * * *

UNITED STATES PATENT AND TRADEMARK OFFICE

CERTIFICATE OF CORRECTION

PATENT NO. : 8,882,399 B2
APPLICATION NO. : 13/829312
DATED : November 11, 2014
INVENTOR(S) : Albert E. Ortega It is certified that error appears in the above-identified patent and that said Letters Patent is hereby corrected as shown below:

Claims

Column 32,
Line 56, Claim 13 “andsomprises” should read --and comprises--.

Signed and Sealed this
Tenth Day of November, 2015

Michelle K. Lee

Michelle K. Lee
*Director of the United States Patent and Trademark Office*